US010401754B2

(12) United States Patent
Gokyu et al.

(10) Patent No.: US 10,401,754 B2
(45) Date of Patent: Sep. 3, 2019

(54) IMAGE FORMING APPARATUS HAVING OPTICAL PRINT HEAD

(71) Applicant: CANON KABUSHIKI KAISHA, Tokyo (JP)

(72) Inventors: Saimon Gokyu, Tokyo (JP); Yasuaki Otoguro, Abiko (JP); Yuta Okada, Moriya (JP); Daisuke Aruga, Abiko (JP); Hitoshi Iwai, Abiko (JP); Shinichiro Hosoi, Tokyo (JP); Yuichiro Imai, Tokyo (JP); Toshiki Momoka, Tokyo (JP); Yoshitaka Otsubo, Tokyo (JP); Takehiro Ishidate, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/001,412

(22) Filed: Jun. 6, 2018

(65) Prior Publication Data

US 2018/0364611 A1 Dec. 20, 2018

(30) Foreign Application Priority Data

Jun. 16, 2017 (JP) ..... 2017-119002

(51) Int. Cl.

| | |
|---|---|
| ***G03G 15/00*** | (2006.01) |
| ***G03G 15/04*** | (2006.01) |
| ***G03G 21/16*** | (2006.01) |

(52) U.S. Cl.

CPC ... *G03G 15/04036* (2013.01); *G03G 21/1647* (2013.01); *G03G 21/1666* (2013.01); *G03G 2221/1654* (2013.01)

(58) Field of Classification Search

CPC ..... G03G 15/04036; G03G 21/1647; G03G 21/1666; G03G 2221/1654

See application file for complete search history.

(56) References Cited

U.S. PATENT DOCUMENTS

| | | | |
|---|---|---|---|
| 8,112,012 | B2 | 2/2012 | Wong et al. |
| 8,269,812 | B2 | 9/2012 | Morimoto et al. |

(Continued)

FOREIGN PATENT DOCUMENTS

| | | | |
|---|---|---|---|
| JP | 2006258909 | A | 9/2006 |
| JP | 2007072321 | A | 3/2007 |

(Continued)

*Primary Examiner* — David M. Gray
*Assistant Examiner* — Michael A Harrison
(74) *Attorney, Agent, or Firm* — Canon U.S.A., Inc. IP Division

(57) ABSTRACT

An exposing unit includes a holding member, an abutting pin protruding on both sides in the vertical direction at the rear side of the holding member, a second support portion provided further to the rear side than the holding member, and a movement mechanism that causes the holding member to move between an exposure position and a retracted position. The second support portion has a gap formed where the rear side of the holding member moves in the vertical direction, and this gap restricts movement of the holding member in the left-and-right direction. The holding member that is moved from the retracted position toward the exposure position by the movement mechanism is guided by the gap formed in the second support portion so that the abutting pin abuts a fitting portion.

20 Claims, 23 Drawing Sheets

(56) References Cited

U.S. PATENT DOCUMENTS

| | | | | |
|---|---|---|---|---|
| 8,305,419 | B2 | 11/2012 | Morita | |
| 8,725,028 | B2 | 5/2014 | Imai | |
| 2007/0024943 | A1 | 2/2007 | Namba | |
| 2007/0126852 | A1* | 6/2007 | Fukutome | B41J 25/304 347/262 |
| 2010/0245525 | A1 | 9/2010 | Morimoto et al. | |
| 2010/0271639 | A1 | 10/2010 | Iijima | |
| 2011/0050834 | A1 | 3/2011 | Umezawa | |
| 2012/0177418 | A1 | 7/2012 | Hashiyada et al. | |
| 2012/0207511 | A1 | 8/2012 | Sato | |
| 2013/0164027 | A1 | 6/2013 | Sato et al. | |
| 2013/0170855 | A1 | 7/2013 | Mori et al. | |
| 2013/0194369 | A1* | 8/2013 | Shimamoto | G03G 15/04045 347/118 |
| 2014/0212170 | A1 | 7/2014 | Kato et al. | |
| 2015/0050043 | A1 | 2/2015 | Sato et al. | |
| 2015/0109398 | A1 | 4/2015 | Park et al. | |
| 2018/0095405 | A1 | 4/2018 | Iwai et al. | |

FOREIGN PATENT DOCUMENTS

| | | | |
|---|---|---|---|
| JP | 2010230954 | A | 10/2010 |
| JP | 2011020414 | A | 2/2011 |
| JP | 2013134370 | A | 7/2013 |
| JP | 2014213541 | A | 11/2014 |
| JP | 2015018132 | A | 1/2015 |

* cited by examiner

FIG. 5A
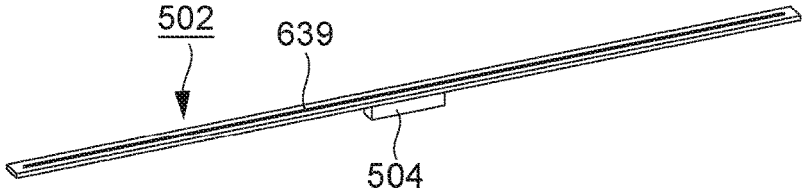
FIG. 5B1
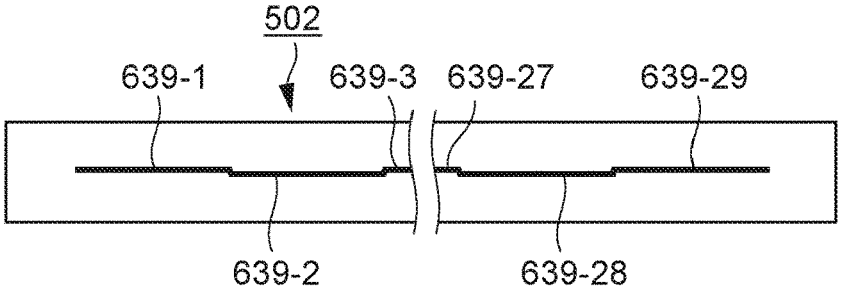
FIG. 5B2
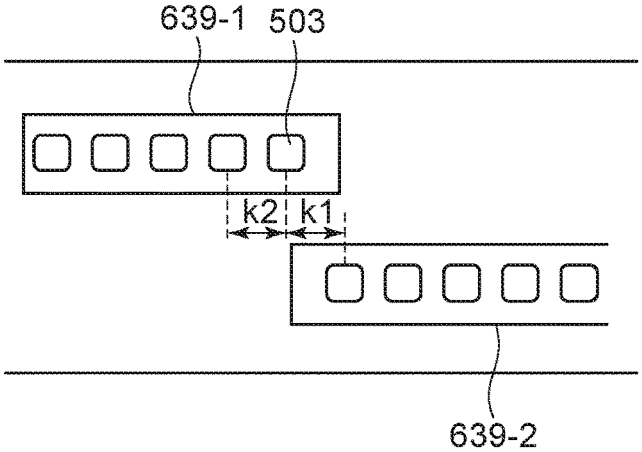
FIG. 5C1
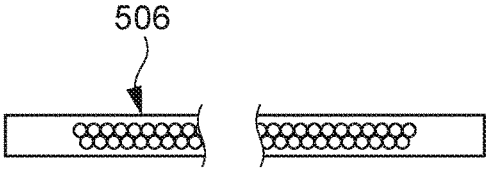
FIG. 5C2
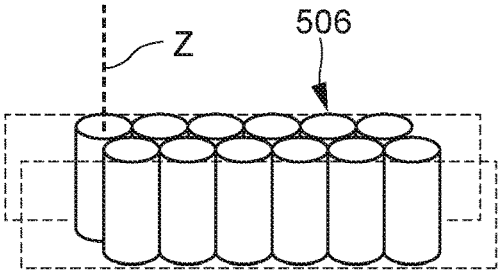

FIG. 7A1
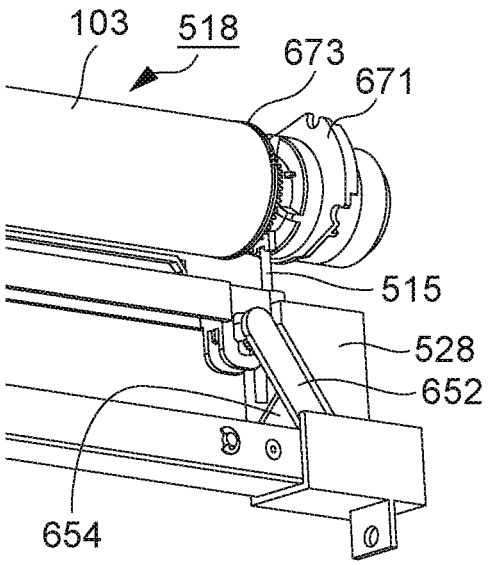
FIG. 7A2
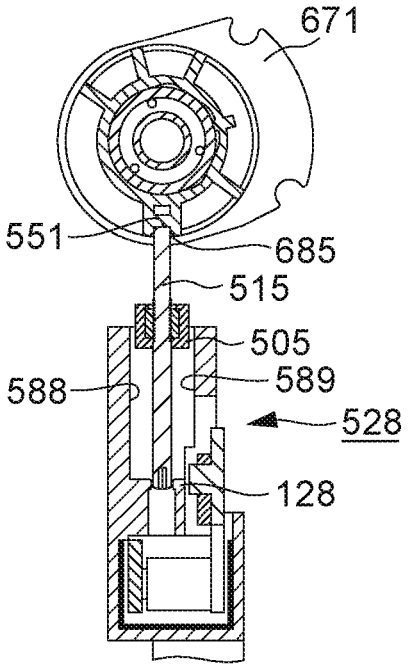
FIG. 7B1
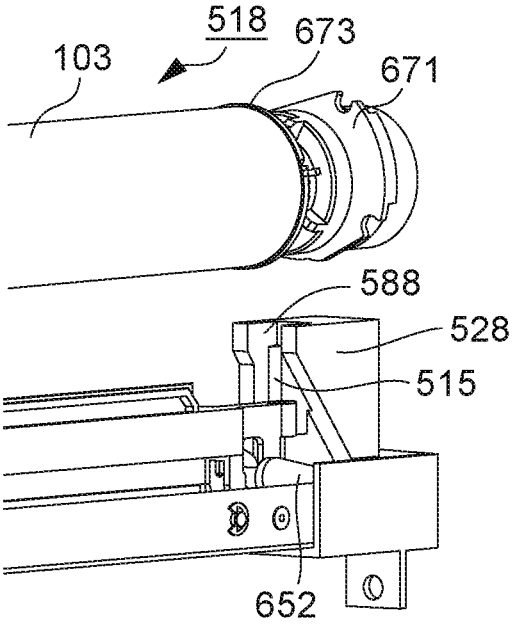
FIG. 7B2
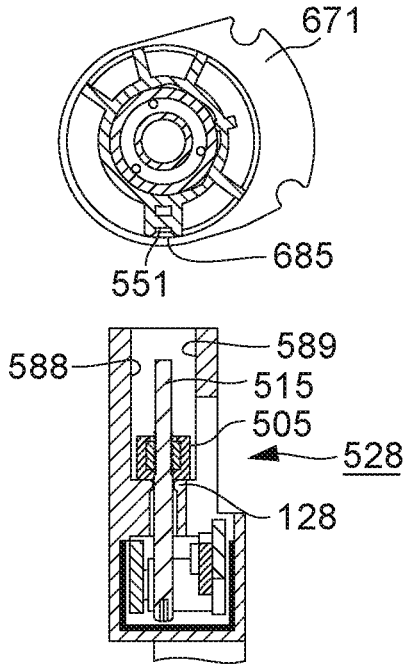

FIG. 15A1
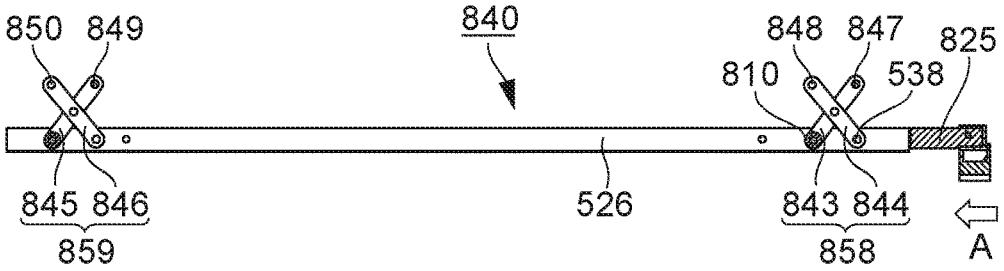
FIG. 15A2
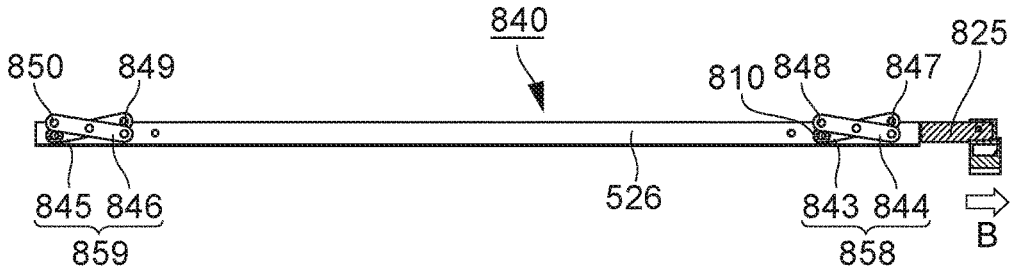
FIG. 15B
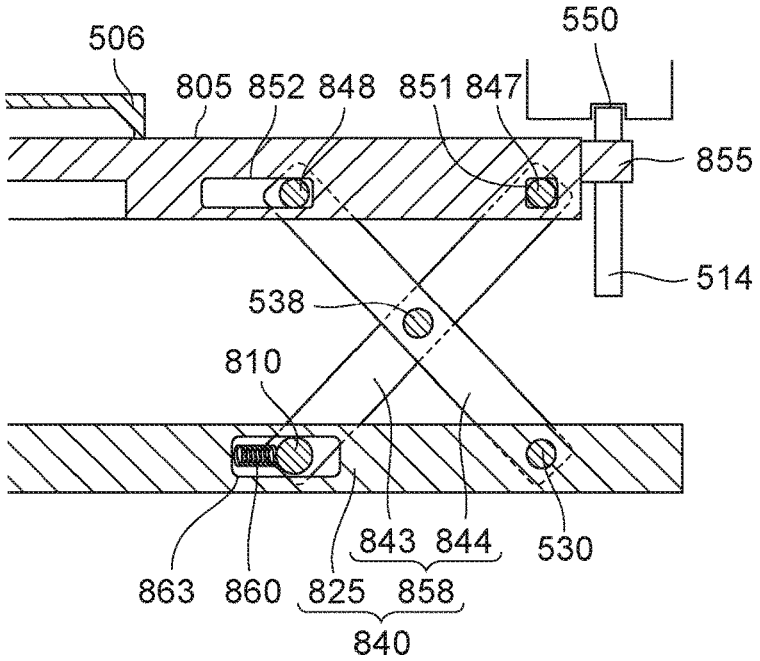

IMAGE FORMING APPARATUS HAVING OPTICAL PRINT HEAD

BACKGROUND OF THE INVENTION

Field of the Invention

The present invention relates to an image forming apparatus having an optical print head that reciprocally moves between an exposure position where a photosensitive drum is exposed, and a retracted position where the optical print head is retracted further from the photosensitive drum than the exposure position, to replace a replacement unit including the photosensitive drum.

Description of the Related Art

Image forming apparatuses such as printers, copying machines, and so forth, have an optical print head that has multiple light-emitting elements for exposing a photosensitive drum. Some optical print heads use light-emitting diodes (LEDs) or organic electroluminescence (EL) devices or the like, which are examples of light-emitting elements. There are known arrangements where multiple such light-emitting elements are arrayed in one row or two staggered rows, for example, in the rotational axis direction of the photosensitive drum. Optical print heads also have multiple lenses for condensing light emitted from the multiple light-emitting elements onto the photosensitive drum. The multiple lenses are disposed facing the surface of the photosensitive drum, having been arrayed in the direction of array of the light-emitting elements, between the multiple light-emitting elements and the photosensitive drum. Light emitted from the multiple light-emitting elements is condensed on the surface of the photosensitive drum through the lenses, and an electrostatic latent image is formed on the photosensitive drum.

The photosensitive drum is a consumable item, and accordingly is periodically replaced. A worker performing the work of replacing a photosensitive drum or the like can perform maintenance of the image forming apparatus by replacing the replacement unit containing the photosensitive drum. The replacement unit has a configuration where it is detachably mountable to a main body of the image forming apparatus, by being extracted from and inserted to the apparatus main body from the side face of the main body of the image forming apparatus by sliding movement. The clearance between the lenses and the surface of the photosensitive drum is extremely narrow at an exposure position of the optical print head for when exposing the photosensitive drum (a position near to and facing the surface of the drum). Accordingly, the optical print head needs to be retracted from the exposure position when replacing the replacement unit, lest the optical print head and photosensitive drum or the like come into contact and the surface of the photosensitive drum and the lenses be damaged. Accordingly, configuration is provided to the image forming apparatus where the optical print head is reciprocally moved between the exposure position and a retracted position where the optical print head is further distanced from the replacement unit than the exposure position, in order to mount/detach the replacement unit.

Japanese Patent Laid-Open No. 2014-213541 discloses an advancing/retreating mechanism 17 that reciprocally moves an optical print head between the exposure position and retracted position. An LPH 14 disclosed in Japanese Patent Laid-Open No. 2014-213541 has a housing 61 having light-emitting elements that expose a photosensitive drum 12. The housing 61 has a first front positioning pin 611F at the one end side in the X-axis direction and a first rear positioning pin 611R at the other end side. The housing 61 also has a second front positioning pin 612F further toward the one end side than the first front positioning pin 611F, and a second rear positioning pin 612R further toward the other end side than the first rear positioning pin 611R. The advancing/retreating mechanism 17 has a lever 172, a cam 305, a lifting and lowering portion 306, and the supporting portion 173b. When the lever is moved in a direction of arrow C (see FIG. 7 of Japanese Patent Laid-Open No. 2014-213541), the cam pivots, and the lifting and lowering portion 306 is moved toward the photosensitive drum 12. The supporting portion 173b is provided to the lifting and lowering portion 306. The supporting portion 173b pushes the first front positioning pin 611F upwards in the Z direction (see FIG. 7 of Japanese Patent Laid-Open No. 2014-213541), and the LED print head 14 moves from a distanced position toward the exposure position.

A frame at the rear side of an image forming apparatus 1 is provided with a rear holding member 1R. The rear holding member 1R has a bracket 91 and an arm 93. The bracket 91 and arm 93 are arranged such that when the exposure module EM is attached to the image forming apparatus 1, the upper side and lower side of the second rear positioning pin 612R fit therebetween, and the second rear positioning pin 612R is restricted from moving in the Y direction (see FIG. 7 of Japanese Patent Laid-Open No. 2014-213541) (positions the LPH 14 in the Y direction).

Accordingly, the LPH 14 moves in the Z direction with movement in the Y direction restricted. When the LPH is raised in the Z direction, the first front positioning pin 611F provided to the front side of the LPH 14 abuts a front BB 122F provided to the front side of a photosensitive module PM, and the first rear positioning pin 611R provided to the rear side of the LPH 14 abuts a rear BB 122R provided to the rear side of the photosensitive module PM, whereby the LPH 14 is positioned at the exposure position.

However, Japanese Patent Laid-Open No. 2014-213541 discloses a mechanism where (1) a function of forming a gap between a photosensitive drum (the photosensitive drum 12) and LPH 14, and (2) a function of restricting movement of a holding member (the housing 61) in the Y direction, are realized using different pins. A structure can be conceived where the functions of the above (1) and (2) are realized by common pins, as a structure where this mechanism has been simplified. In order to increase the amount of retraction of the holding member situated at the retracted position from the photosensitive drum, the length of a pin protruding from the lower side of the holding member needs to be longer. In this case, the separation distance between the holding member and the photosensitive drum is long when the holding member is at the retracted position, so it is difficult to restrict motion of the pin in the Y direction at the upper side of the holding member. On the other hand, restricting movement of the pin in the Y direction only at the lower side of the holding member will result in a long distance for the pin from the restricting position to the end portion of the replacement unit (photosensitive module PM) side, and it is difficult to restrict the pin from inclining in the Y direction while the holding member is traveling. Accordingly, there is a possibility that it will be difficult to abut the pin against the abutting portion of the replacement unit (front BB 122F or rear BB 122R).

SUMMARY OF THE INVENTION

An image forming apparatus according to the present invention has a drum unit rotatably supporting a photosensitive drum. The image forming apparatus includes: an optical print head configured to expose the photosensitive drum; a movement mechanism configured to reciprocally move the optical print head between an exposure position where the photosensitive drum is exposed, and a retracted position that is further retracted from the drum unit than the exposure position; an abutting pin that is formed protruding from one end side of the optical print head in the longitudinal direction of the optical print head, in a direction toward the drum unit side in the direction of the reciprocal movement and a direction opposite to the drum unit side, and that is configured to abut an abutting portion formed on one end side of the drum unit in the longitudinal direction and to position the optical print head at the exposure position; a first facing portion that is provided facing both sides of the abutting pin in a perpendicular direction perpendicular to both the longitudinal direction and direction of reciprocal movement, at the opposite side of the optical print head as to the side where the drum unit is disposed, and that is configured to come into contact with the abutting pin in the perpendicular direction, to restrict movement of the abutting pin in the perpendicular direction; and a second facing portion that is provided facing both sides of the optical print head in the perpendicular direction, and that comes into contact with the optical print head in the perpendicular direction, to restrict movement of the optical print head moving from the retracted position toward the exposure position and also to move the optical print head in the direction of reciprocal movement. The abutting pin is guided to move toward the abutting portion by the first facing portion and the second facing portion, due to movement of the abutting pin in the perpendicular direction being restricted by the first facing portion and movement of the optical print head in the perpendicular direction being restricted by the second facing portion, and the optical print head being moved from the retracted position toward the exposure position by the movement mechanism is positioned at the exposure position.

An image forming apparatus according to the present invention has a drum unit rotatably supporting a photosensitive drum. The image forming apparatus includes: an optical print head configured to expose the photosensitive drum; a movement mechanism configured to reciprocally move the optical print head between an exposure position where the photosensitive drum is exposed, and a retracted position that is further retracted from the drum unit than the exposure position; an abutting pin that is formed protruding from one end side of the optical print head in the longitudinal direction of the optical print head, in a direction toward the drum unit side in the direction of the reciprocal movement and a direction opposite to the drum unit side, and that is configured to abut an abutting portion formed on one end side of the drum unit in the longitudinal direction and to position the optical print head at the exposure position; a first fitted portion in which a gap is formed with a spacing opened in a perpendicular direction perpendicular to both the longitudinal direction and direction of reciprocal movement, to which the abutting pin fits, to restrict movement of the abutting pin in the perpendicular direction; and a second fitted portion in which a gap is formed with a spacing opened in the perpendicular direction, to which one end side of the optical print head in the longitudinal direction fits, to restrict movement of the optical print head moving from the retracted position toward the exposure position in the perpendicular direction and also to move the optical print head in the direction of reciprocal movement. The abutting pin is guided to move toward the abutting portion by the first fitted portion and the second fitted portion, due to movement of the abutting pin in the perpendicular direction being restricted by the first fitted portion and movement of the optical print head in the perpendicular direction being restricted by the second fitted portion, and the optical print head being moved from the retracted position toward the exposure position by the movement mechanism is positioned at the exposure position.

An image forming apparatus according to the present invention has a drum unit rotatably supporting a photosensitive drum. The image forming apparatus includes: an optical print head configured to expose the photosensitive drum; a movement mechanism configured to reciprocally move the optical print head between an exposure position where the photosensitive drum is exposed, and a retracted position that is further retracted from the drum unit than the exposure position; an abutting pin that is formed protruding from an other end side of the optical print head in the longitudinal direction of the optical print head, in a direction toward the drum unit side in the direction of the reciprocal movement and a direction opposite to the drum unit side, and that is configured to abut an abutting portion formed on the other end side of the drum unit in the longitudinal direction and to position the optical print head at the exposure position; a first facing portion that is provided facing both sides of the abutting pin in a perpendicular direction perpendicular to both the longitudinal direction and direction of reciprocal movement, at the opposite side of the optical print head as to the side where the drum unit is disposed, and that is configured to come into contact with the abutting pin in the perpendicular direction, to restrict movement of the abutting pin in the perpendicular direction; and a second facing portion that is provided facing both sides of the optical print head in the perpendicular direction, and that comes into contact with the optical print head in the perpendicular direction, to restrict movement of the optical print head moving from the retracted position toward the exposure position in the perpendicular direction and also to move the optical print head in the direction of reciprocal movement. The abutting pin is guided to move toward the abutting portion by the first facing portion and the second facing portion, due to movement of the abutting pin in the perpendicular direction being restricted by the first facing portion and movement of the optical print head in the perpendicular direction being restricted by the second facing portion, and the optical print head being moved from the retracted position toward the exposure position by the movement mechanism is positioned at the exposure position.

An image forming apparatus according to the present invention has a drum unit rotatably supporting a photosensitive drum. The image forming apparatus includes: an optical print head configured to expose the photosensitive drum; a movement mechanism configured to reciprocally move the optical print head between an exposure position where the photosensitive drum is exposed, and a retracted position that is further retracted from the drum unit than the exposure position; an abutting pin that is formed protruding from an other end side of the optical print head in the longitudinal direction of the optical print head, in a direction toward the drum unit side in the direction of the reciprocal movement and a direction opposite to the drum unit side, and that is configured to abut an abutting portion formed on the other end side of the drum unit in the longitudinal direction and to position the optical print head at the exposure position; a first fitted portion in which a gap is formed with a spacing opened in a perpendicular direction perpendicular to both the longitudinal direction and direction of reciprocal movement, to restrict movement of the abutting pin in the perpendicular direction; and a second fitted portion in which a gap is formed with a spacing opened in the perpendicular direction, to which the other side of the optical print head in the longitudinal direction fits, to restrict movement of the optical print head moving from the retracted position toward the exposure position in the perpendicular direction and also to move the optical print head in the direction of reciprocal movement. The abutting pin is guided to move toward the abutting portion by the first fitted portion and the second fitted portion, due to movement of the abutting pin in the perpendicular direction being restricted by the first fitted portion and movement of the optical print head in the perpendicular direction being restricted by the second fitted portion, and the optical print head moving from the retracted position toward the exposure position by the movement mechanism is positioned at the exposure position.

Further features of the present invention will become apparent from the following description of exemplary embodiments with reference to the attached drawings.

BRIEF DESCRIPTION OF THE DRAWINGS

FIGS. 5A through 5C2 are schematic diagrams for describing a circuit board, LED chips, and lens array of an optical print head.

FIGS. 7A1 through 7B2 are diagrams illustrating a state where an optical print head is in contact with a drum unit, and a retracted state.

FIGS. 15A1 through 15B are diagrams describing an X-type movement mechanism.

DESCRIPTION OF THE EMBODIMENTS

Embodiment

Image Forming Apparatus

Figure 1:
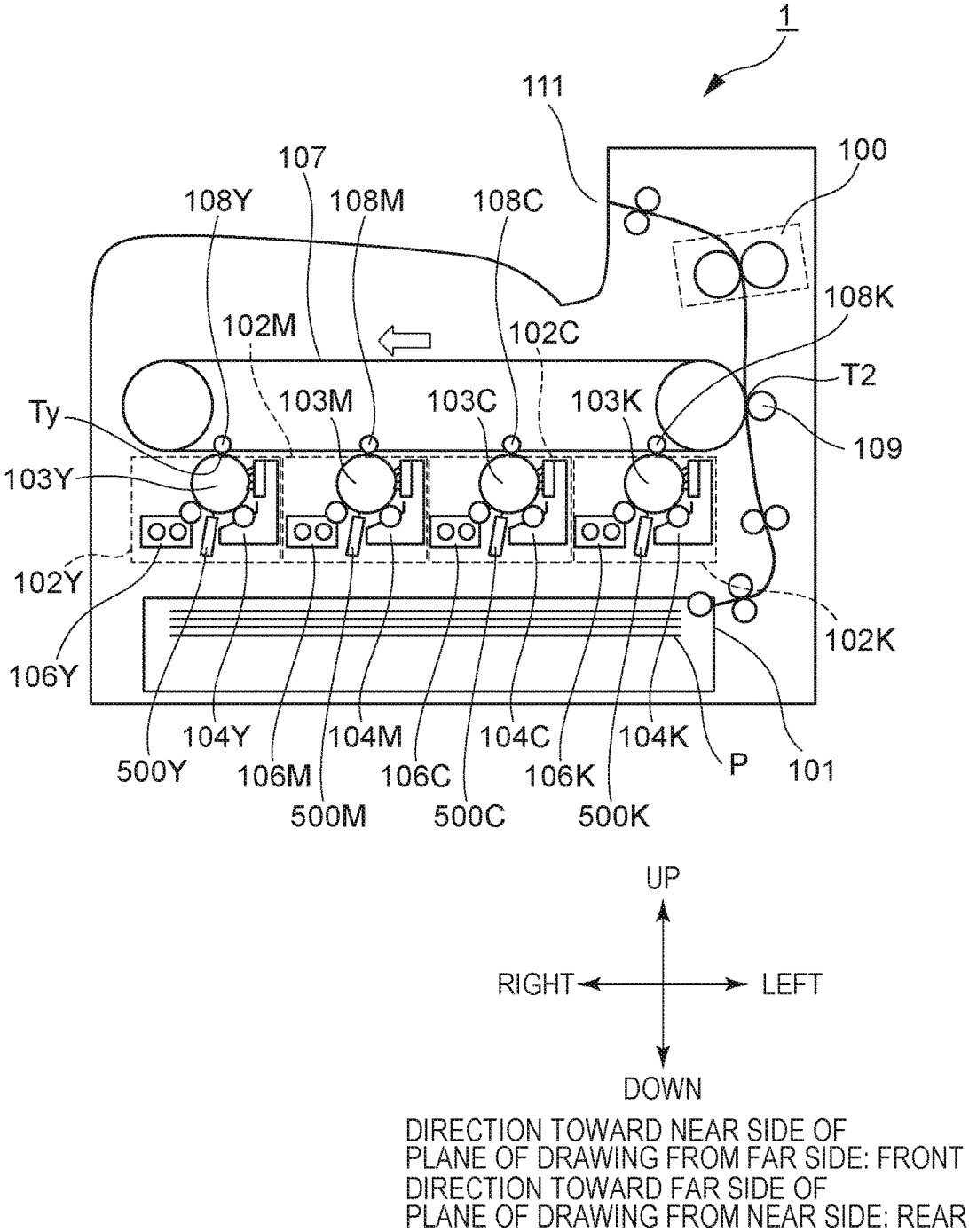
FIG. 1 is a schematic cross-sectional diagram of an image forming apparatus.

First, a schematic configuration of an image forming apparatus 1 will be described. FIG. 1 is a schematic cross-sectional view of the image forming apparatus 1. Although the image forming apparatus 1 illustrated in FIG. 1 is a color printer that does not have a reader, an embodiment may be a copying machine that has a reader. Also, an embodiment is not restricted to a color image forming apparatus having multiple photosensitive drums 103 as illustrated in FIG. 1, and may be a color image forming apparatus having one photosensitive drum 103 or an image forming apparatus that forms monochromatic images.

The image forming apparatus 1 illustrated in FIG. 1 has four image forming units 102Y, 102M, 102C, and 102K (hereinafter also collectively referred to simply as "image forming unit 102") that form toner images of the yellow, magenta, cyan, and black colors. The image forming units 102Y, 102M, 102C, and 102K respectively have a photosensitive drum 103Y, 103M, 103C, and 103K (hereinafter also collectively referred to simply as "photosensitive drum 103"). The image forming units 102Y, 102M, 102C, and 102K also respectively have a charger 104Y, 104M, 104C, and 104K (hereinafter also collectively referred to simply as "charger 104") for charging the photosensitive drums 103Y, 103M, 103C, and 103K. The image forming units 102Y, 102M, 102C, and 102K further respectively have a light-emitting diode (LED) exposing unit 500Y, 500M, 500C, and 500K (hereinafter also collectively referred to simply as "LED exposing unit 500") serving as an exposure light source that emits light to expose the photosensitive drums 103Y, 103M, 103C, and 103K. Moreover, the image forming units 102Y, 102M, 102C, and 102K respectively have a developing unit 106Y, 106M, 106C, and 106K (hereinafter also collectively referred to simply as "developing unit 106") that develops electrostatic latent images on the photosensitive drum 103 by toner, thereby developing toner images of the respective colors on the photosensitive drums 103. The Y, M, C, and K appended to the reference numerals indicate the color of the toner.

The image forming apparatus 1 is provided with an intermediate transfer belt 107 onto which toner images formed on the photosensitive drums 103 are transferred, and primary transfer roller 108 (Y, M, C, K) that sequentially transfer the toner images formed on the photosensitive drums 103 of the image forming units 102 onto the intermediate transfer belt 107. The image forming apparatus 1 further is provided with a secondary transfer roller 109 that transfers the toner image on the intermediate transfer belt 107 onto a recording sheet P conveyed from a sheet feed unit 101, and a fixing unit 100 that fixes the secondary-transferred image onto the recording sheet P.

Drum Unit

Figure 2A:
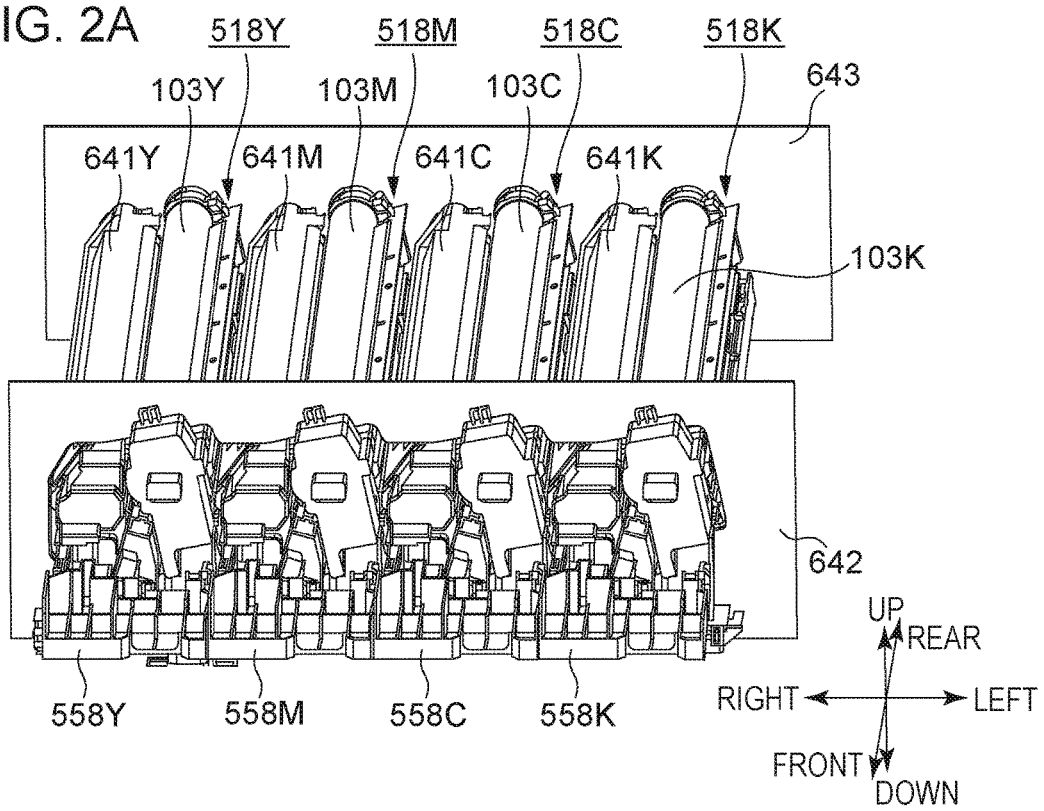
FIGS. 2A and 2B are perspective views of around drum units in the image forming apparatus.
Figure 2B:
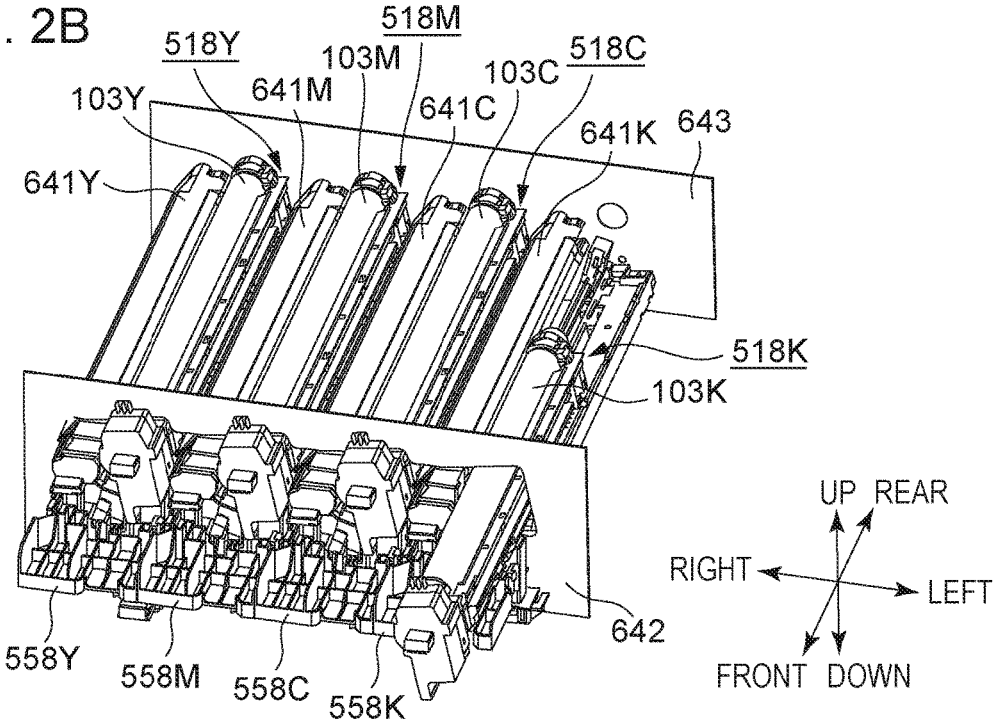

Next, drum units 518 (Y, M, C, K), and developing units 641 (Y, M, C, K), which are detachably mounted to the image forming apparatus 1 according to the present embodiment, will be described. FIG. 2A is a schematic perspective view around the drum units 518 and developing units 641 that the image forming apparatus 1 has. FIG. 2B is a diagram illustrating a drum unit 518 in a state partially inserted into the image forming apparatus 1 from the outer side of the apparatus main body.

The image forming apparatus 1 has a front-side plate 642 and a rear-side plate 643 that are formed from sheet metal, as illustrated in FIG. 2A. The front-side plate 642 is a side wall provided to the front side of the image forming apparatus 1. The rear-side plate 643 is a side wall provided to the rear side of the image forming apparatus 1. The front-side plate 642 and rear-side plate 643 are disposed facing each other as illustrated in FIG. 2A, with sheet metal serving as beams that are omitted from illustration crossing therebetween. The front-side plate 642, rear-side plate 643, and unshown beams make up part of a frame of the image forming apparatus 1.

Openings are formed on the front-side plate 642, through which the drum units 518 and developing units 641 can be inserted and extracted from the front side of the image forming apparatus 1. The drum units 518 and developing units 641 are mounted through openings to predetermined positions in the main body of the image forming apparatus 1 (mounting positions). The image forming apparatus 1 also has covers 558 (Y, M, C, K), serving as an example of pivoting members, that cover the front side of the drum units 518 and developing units 641 mounted to the mounting positions. The covers 558 have one end thereof fixed to the main body of the image forming apparatus 1 by a hinge, and are capable of pivoting as to the main body of the image forming apparatus 1 on the hinge. Unit replacement work is completed by a worker who performs maintenance opening a cover 558 and extracting a drum unit 518 or developing unit 641 within the main body, inserting a new drum unit 518 or developing unit 641, and closing the cover 558. The covers 558 will be described in detail later.

In the following description, the front-side plate 642 side of the image forming apparatus 1 is defined as the front side, and the rear-side plate 643 side as the rear side, as illustrated in FIGS. 2A and 2B. The side where the photosensitive drum 103Y that forms electrostatic latent images relating to yellow toner images is disposed is defined as the right side, with the photosensitive drum 103K that forms electrostatic latent images relating to black toner images as a reference. The side where the photosensitive drum 103K that forms electrostatic latent images relating to black toner images is disposed is defined as the left side, with the photosensitive drum 103Y that forms electrostatic latent images relating to yellow toner images as a reference. Further, a direction that is perpendicular to the front-and-rear directions and left-and-right directions defined here, and is upward in the vertical direction is defined as the upward direction, and a direction that is perpendicular to the front-and-rear directions and left-and-right directions defined here, and is downward in the vertical direction is defined as the downward direction. The defined front direction, rear direction, right direction, left direction, upward direction, and downward direction, are illustrated in FIGS. 2A and 2B. The term "one end side of the photosensitive drum 103 in the rotational axis direction" as used in the present specification means the front side as defined here, and "other end side" means the rear side as defined here. The one end side and other end side in the front-and-rear direction here also correspond to the front side and rear side defined here. The one end side in the left-and-right direction means the right side as defined here, and the other end side means the left side as defined here.

Drum units 518 are attached to the image forming apparatus 1 according to the present embodiment. The drum units 518 are cartridges that are replaced. The drum units 518 according to the present embodiment have photosensitive drums 103 rotatably supported as to the casing of the drum units 518. The drum units 518 each have a photosensitive drum 103, charger 104, and cleaning device that is omitted from illustration. When the lifespan of a photosensitive drum 103 is expended due to wear by cleaning by the cleaning device for example, a worker who performs maintenance extracts the drum unit 518 from the apparatus main body, and replaces the photosensitive drum 103, as illustrated in FIG. 2B. Note that a configuration may be made where the drum unit 518 includes neither the charger 104 nor cleaning device, and only includes the photosensitive drum 103.

The developing units 641, which are separate from the drum units 518, are attached to the image forming apparatus 1 according to the present embodiment. The developing units 641 include the developing units 106 illustrated in FIG. 1. Each developing unit 106 is provided with a developing sleeve serving as a developing agent bearing member that bears a developing agent. Each developing unit 641 is provided with multiple gears for rotating a screw that agitates the toner and a carrier. When these gears deteriorate due to age or the like, a worker performing maintenance extracts the developing unit 641 from the apparatus main body of the image forming apparatus 1 and replaces it. The developing unit 641 according to the present embodiment is a cartridge where a developing unit 106 having a developing sleeve, and a toner container in which a screw is provided, have been integrated. An embodiment of the drum unit 518 and developing unit 641 may be a process cartridge where the above-described drum unit 518 and developing unit 641 are integrated.

Image Forming Process

Next, an image forming process will be described. A later-described optical print head 105Y exposes the surface of the photosensitive drum 103Y that has been charged by the charger 104Y. Accordingly, an electrostatic latent image is formed on the photosensitive drum 103Y. Next, the developing unit 106Y develops the electrostatic latent image formed on the photosensitive drum 103Y by yellow toner. The yellow toner image developed on the surface of the photosensitive drum 103Y is transferred onto the intermediate transfer belt 107 by the primary transfer roller 108Y at a primary transfer position Ty. Magenta, cyan, and black toner images are also transferred onto the intermediate transfer belt 107 by the same image forming process.

The toner images of each color transferred onto the intermediate transfer belt 107 are conveyed to a secondary transfer position T2 by the intermediate transfer belt 107. Transfer bias for transferring the toner images onto a recording sheet P is applied to the secondary transfer roller 109 disposed at the secondary transfer position T2. The toner images conveyed to the secondary transfer position T2 are transferred onto a recording sheet P conveyed from the sheet feed unit 101 by the transfer bias of the secondary transfer roller 109. The recording sheet P onto which the toner images have been transferred is conveyed to the fixing unit 100. The fixing unit 100 fixes the toner images onto the recording sheet P by heat and pressure. The recording sheet P subjected to fixing processing by the fixing unit 100 is discharged to a sheet discharge unit 111.

Exposing Unit

Figure 3:
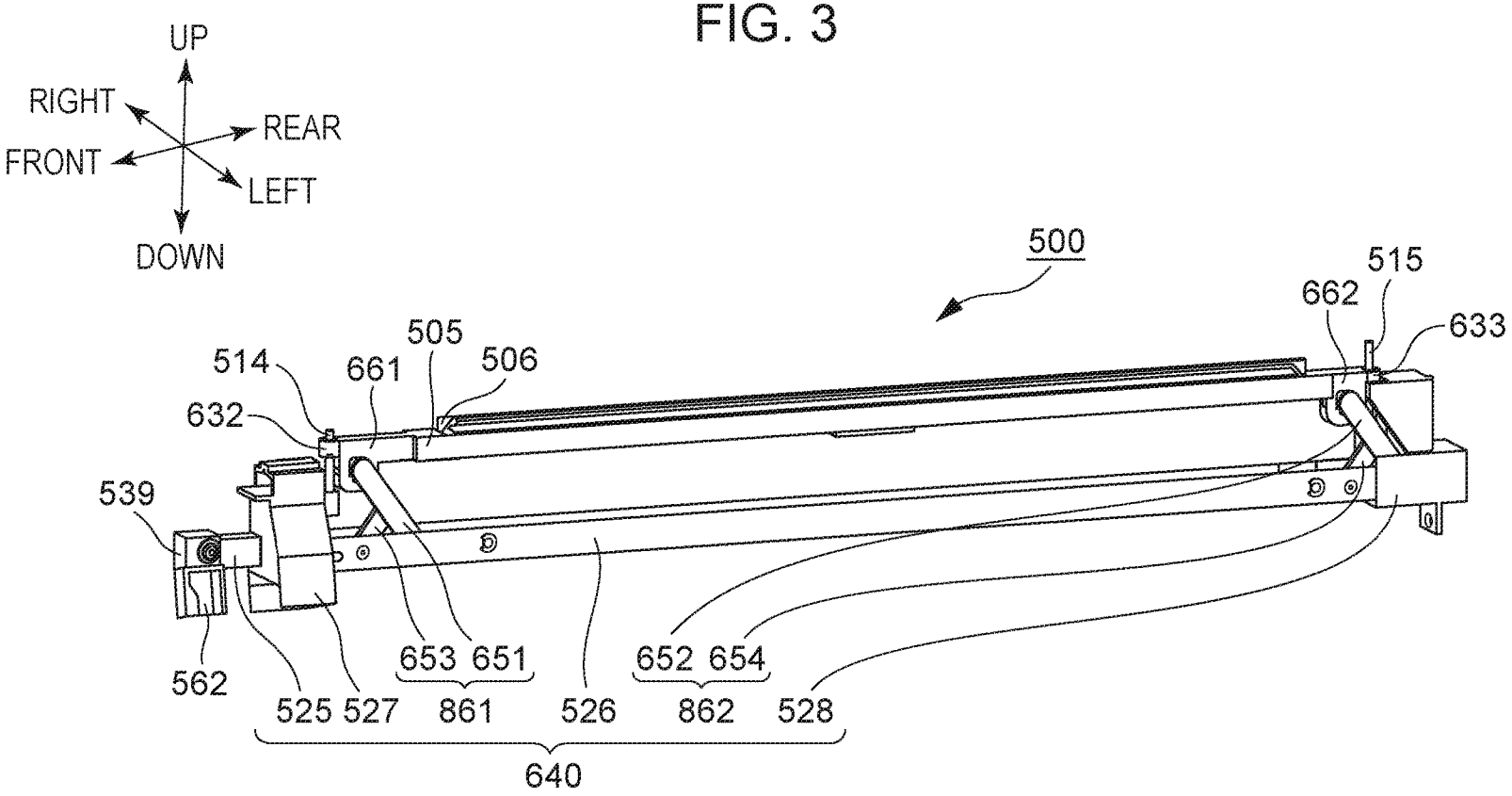
FIG. 3 is a schematic perspective view of an exposing unit.
Figure 4:
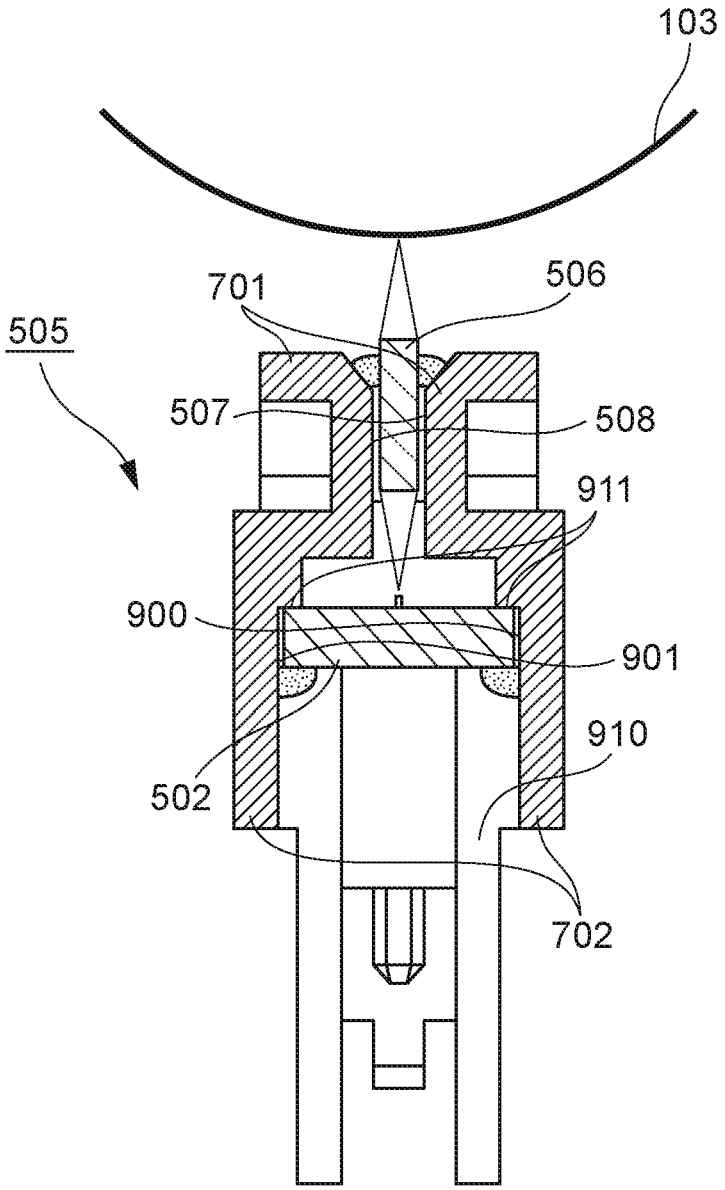
FIG. 4 is a cross-sectional view of an optical print head, taken along a direction perpendicular to a rotational axis of a photosensitive drum.

The exposing unit 500 including the optical print head 105 will be described next. Laser beam scanning exposure, where an emitted semiconductor laser beam is scanned using a rotating polygon mirror or the like and the photosensitive drum is exposed via an F-theta lens or the like is known as one example of an exposing method employed in electrophotographic image forming apparatuses. The "optical print head 105" described in the present embodiment is used in LED exposure where light-emitting elements such as LEDs or the like arrayed following the rotational axis direction of the photosensitive drum 103 are used to expose the photosensitive drum 103, but is not used in the above-described laser beam scanning exposure. FIG. 3 is a schematic perspective view of the exposing unit 500 that the image forming apparatus 1 according to the present embodiment has. FIG. 4 is a schematic cross-sectional diagram where the exposing unit 500 illustrated in FIG. 3, and the photosensitive drum 103 disposed to the upper side of the exposing unit 500, have been cut away on a plane perpendicular to the rotational axis direction of the photosensitive drum 103. The optical exposing unit 500 has the optical print head 105 and a movement mechanism 640. The optical print head 105 has a lens array 506 serving as lenses, a circuit board 502, a holding member 505 holding the lens array 506, an abutting pin 514, and an abutting pin 515. The abutting pin 514 is provided at one end side (front side) of the optical print head 105 in the longitudinal direction, and the abutting pin 515 is provided at the other end side (rear side) of the optical print head 105 in the longitudinal direction. The movement mechanism 640 includes a link member 651, link member 652, sliding portion 525, first support portion 527, second support portion 528, and a third support portion 526 serving as an example of a slide supporting portion. Although the abutting pin 514 and abutting pin 515 are described as being cylindrical pins in the present embodiment, the shape thereof is not restricted to being cylindrical, and may be polygonal posts, or conical shapes where the diameter is tapered toward the tip. One of the abutting pin 514 and abutting pin 515 does no need to be a pin, and may be a protrusion protruding to the upper side and lower side of the holding member 505 for example, having equivalent functions as a pin.

First, the holding member 505 will be described. The holding member 505 is a holder that holds the later-described circuit board 502, lens array 506, abutting pin 514, and abutting pin 515. As one example in the present embodiment, the length of the abutting pin 514 protruding from the upper face of the holding member 505 is 7 mm, the length of the abutting pin 515 protruding from the upper face of the holding member 505 is 11 mm, the length of the abutting pin 514 protruding from the lower face of the holding member 505 is 22 mm, and the length of the abutting pin 515 protruding from the lower face of the holding member 505 is 22 mm. The holding member 505 is provided with lens attaching portions 701 where the lens array 506 is attached, and circuit board attaching portions 702 where the circuit board 502 is attached, as illustrated in FIG. 4. The holding member 505 also has spring attaching portion 661, spring attaching portion 662, pin attaching portion 632, and pin attaching portion 633, which will be described later with reference to FIGS. 22A through 22D. The holding member 505 according to the present embodiment has the lens attaching portion 701, circuit board attaching portion 702, spring attaching portion 661, spring attaching portion 662, pin attaching portion 632, and pin attaching portion 633. The holding member 505 is a molded resin article, where the lens attaching portion 701, circuit board attaching portion 702, spring attaching portion 661, and spring attaching portion 662, have been integrally formed by injection molding. Note that the material of the holding member 505 is not restricted to resin, and may be metal or the like, for example.

The spring attaching portion 661 to which the link member 651 is attached is provided between the lens array 506 and the pin attaching portion 632 in the front-and-rear direction, as illustrated in FIG. 3. Also, the spring attaching portion 662 to which the link member 652 is attached is provided between the lens array 506 and the pin attaching portion 633 in the front-and-rear direction. That is to say, the holding member 505 is supported by the link member 651 between the lens array 506 and abutting pin 514 in the front-and-rear direction, and is supported by the link member 652 between the lens array 506 and abutting pin 515 in the front-and-rear direction, when the optical print head 105 moves between the exposure position and the retracted position. Portions where biasing force is applied to the holding member 505 by the link member 651 and link member 652 do not overlap the lens array 506 in the vertical direction, so warping of the lens array 506 due to this biasing force is reduced.

The lens attaching portion 701 has a first inner wall face 507 that extends in the longitudinal direction of the holding member 505, and a second inner wall face 508 that faces the first inner wall face 507 and also extends in the longitudinal direction of the holding member 505. The lens array 506 is inserted between the first inner wall face 507 and the second inner wall face 508 when assembling the optical print head 105. Adhesive agent is coated between the side face of the lens array 506 and the lens attaching portion 701, thereby fixing the lens array 506 to the holding member 505.

The circuit board attaching portion 702 has a cross-sectional open-box shape, and has a third inner wall face 900 extending in the longitudinal direction of the holding member 505, and a fourth inner wall face 901 that faces the third inner wall face 900 and extends in the longitudinal direction of the holding member 505, as illustrated in FIG. 4. A gap 910 into which the circuit board 502 is inserted is formed between the third inner wall face 900 and fourth inner wall face 901. The circuit board attaching portion 702 also includes circuit board abutting portions 911 where the circuit board 502 abuts. The circuit board 502 is inserted from the gap 910 when assembling the optical print head 105, and pressed as far as the circuit board abutting portions 911. Adhesive agent is coated on the boundary portion between the gap 910 side of the circuit board 502 and the third inner wall face 900 and fourth inner wall face 901 in a state where the circuit board 502 is abutted against the circuit board abutting portions 911, thereby fixing the circuit board 502 to the holding member 505. The exposing unit 500 is disposed on the lower side in the vertical direction from the rotational axis of the photosensitive drum 103, and LEDs 503 that the optical print head 105 has expose the photosensitive drum 103 from below. Note that a configuration may be made where the exposing unit 500 is provided to the upper side from the rotational axis of the photosensitive drum 103 in the vertical direction, with the LEDs 503 of the optical print head 105 exposing the photosensitive drum 103 from above.

Next, the circuit board 502 held by the holding member 505 will be described. FIG. 5A is a schematic perspective diagram of the circuit board 502. FIG. 5B1 illustrates an array of multiple LEDs 503 provided to the circuit board 502, and FIG. 5B2 is an enlarged view of FIG. 5B1.

LED chips 639 are mounted on the circuit board 502. The LED chips 639 are mounted on one face of the circuit board 502, while a connector 504 is provided to the rear face side, as illustrated in FIG. 5A. The circuit board 502 is provided with wiring to supply signals to the LED chip 639. One end of a flexible flat cable (FFC) that is omitted from illustration is connected to the connector 504. A circuit board is provided to the main body of the image forming apparatus 1. The circuit board has a control unit and connector. The other end of the FFC is connected to this connector. Control signals are input to the circuit board 502 from the control unit of the main body of the image forming apparatus 1 via the FFC and connector 504. The LED chips 639 are driven by the control signals input to the circuit board 502.

The LED chips 639 mounted on the circuit board 502 will be described in further detail. Multiple (29) LED chips 639-1 through 639-29, on which multiple LEDs 503 are arrayed, are arrayed on one face of the circuit board 502, as illustrated in FIGS. 5B1 and 5B2. Each of the LED chips 639-1 through 639-29 has 516 LEDs (light-emitting elements) arrayed in a single row in the longitudinal direction thereof. The center-to-center distance k2 between LEDs adjacent in the longitudinal direction in the LED chips 639 corresponds to the resolution of the image forming apparatus 1. The resolution of the image forming apparatus 1 according to the present embodiment is 1200 dpi, so the LEDs are arrayed in a single row so that the center-to-center distance k2 between adjacent LEDs in the longitudinal direction of the LED chips 639-1 through 639-29 is 21.16 μm. Accordingly, the range of exposure of the optical print head 105 according to the present embodiment is 316 mm. The photosensitive layer of the photosensitive drum 103 is formed 316 mm or wider. The long side of an A4-size recording sheet and the short side of an A3-size recording sheet are 297 mm, so the optical print head 105 according to the present embodiment has an exposing range capable of forming images on A4-size recording sheets and A3-size recording sheets.

The LED chips 639-1 through 639-29 are alternately arrayed to form two rows in the rotational axis direction of the photosensitive drum 103. That is to say, odd-numbered LED chips 639-1, 639-3, and so on through 639-29, are arrayed on one line in the longitudinal direction of the circuit board 502 from the left, and even-numbered LED chips 639-2, 639-2, and so on through 639-28, are arrayed on one line in the longitudinal direction of the circuit board 502, as illustrated in FIG. 5B1. Arraying the LED chips 639 in this way enables the center-to-center distance k1 between the LEDs disposed on one end of one LED chip 639 and the other end of another LED chip 639 among different adjacent LED chips 639 to be equal to the center-to-center distance k2 of LEDs on the same LED chip 639, in the longitudinal direction of the LED chips 639, as illustrated in FIG. 5B2.

An example where the exposing light source is configured using LEDs is described in the present embodiment. However, organic electroluminescence (EL) devices may be used instead of the exposing light source.

Next, the lens array 506 will be described. FIG. 5C1 is a schematic diagram viewing the lens array 506 from the photosensitive drum 103 side. FIG. 5C2 is a schematic perspective view of the lens array 506. These multiple lenses are arrayed in two rows following the direction of array of the multiple LEDs 503, as illustrated in FIG. 5C1. The lenses are disposed in a staggered manner such that each lens in one row comes into contact with two lenses in the other row that are adjacent in the direction of array of the lenses. The lenses are cylindrical glass rod lenses. Note that the material of the lenses is not restricted to glass, and that plastic may be used. The shape of the lenses is not restricted to a cylindrical shape either, and may be polygonal posts such as hexagonal posts or the like, for example.

A dotted line Z in FIG. 5C2 indicates the optical axis of a lens. The optical print head 105 is moved by the above-described movement mechanism 640 in a direction generally following the optical axis of the lens indicated by the dotted line Z. The term optical axis of a lens here means a line that connects the center of the light emitting face of the lens and the focal point of this lens. The discharged light emitted from an LED enters a lens included in the lens array 506, as illustrated in FIG. 4. The lens functions to condense the discharged light entering the lens onto the surface of the photosensitive drum 103. The attachment position of the lens array 506 as to the lens attaching portion 701 is adjusted when assembling the optical print head 105, such that the distance between the light-emitting face of the LED and incoming light face of the lens, and the distance between the light-emitting face of the lens and the surface of the photosensitive drum 103, are generally equal.

Figure 6A:
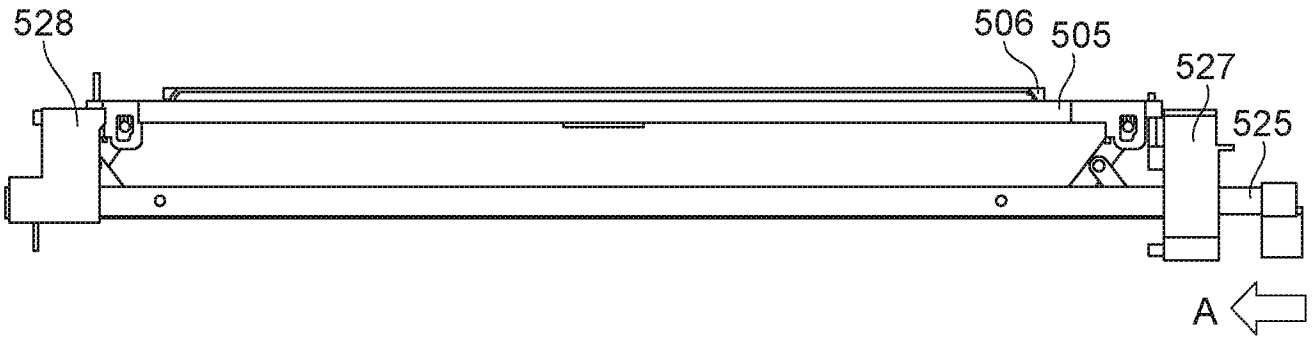
FIGS. 6A and 6B are side views of an optical print head.
Figure 6B:
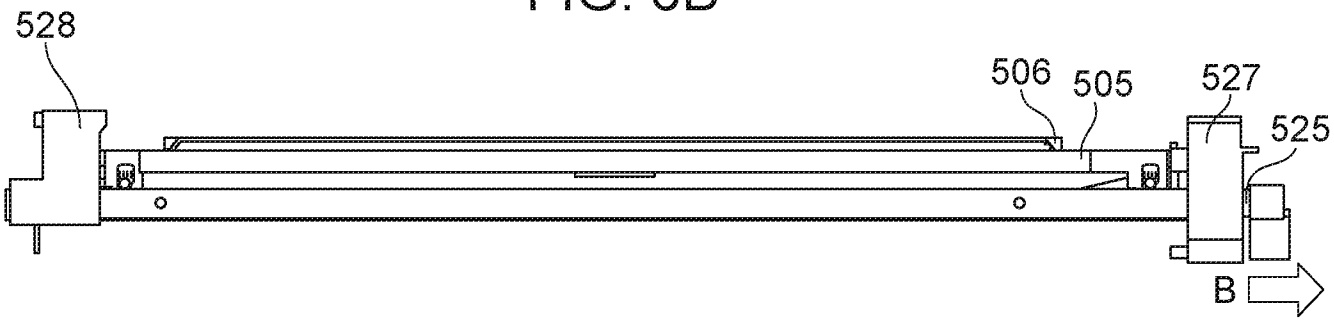

Now, the necessity of moving the optical print head 105 will be described. When replacing a drum unit 518 in the image forming apparatus 1 according to the present embodiment, the drum unit 518 is moved by sliding in the rotational axis direction of the photosensitive drum 103 to the front side of the apparatus main body, as illustrated in FIG. 2B. Moving the drum unit 518 in a state where the optical print head 105 is situated near the surface of the photosensitive drum 103 results in the drum unit 518 coming into contact with the surface of the photosensitive drum 103 while moving by sliding, and the surface of the photosensitive drum 103 being mounted will be scratched. Also, the lens array 506 will come into contact with the frame of the drum unit 518 and the lens array 506 will be scratched. Accordingly, a structure is necessary where the optical print head 105 is reciprocally moved between an exposure position (FIG. 6A) where the photosensitive drum 103 is exposed, and a retracted position (FIG. 6B) retracted from the exposure position. When the sliding portion 525 moves by sliding in the direction of arrow A with the optical print head 105 at the exposure position (FIG. 6A), the optical print head 105 moves in a direction toward the retracted position (FIG. 6B). On the other hand, when the sliding portion 525 moves by sliding in the direction of arrow B with the optical print head 105 at the retracted position (FIG. 6B), the optical print head 105 moves in a direction toward the exposure position (FIG. 6A). This will be described in detail later.

FIG. 7A1 is a perspective view illustrating a bushing 671 provided to the rear side of the optical print head 105 situated in the exposure position and the rear side of the drum unit 518. FIG. 7A2 is a cross-sectional view illustrating the second support portion 528 and the bushing 671 provided to the rear side of the drum unit 518 when the optical print head 105 situated in the exposure position. FIG. 7B1 is a perspective view illustrating the bushing 671 provided to the rear side of the optical print head 105 situated in the retracted position and the rear side of the drum unit 518. FIG. 7B2 is a cross-sectional view illustrating the second support portion 528 and the bushing 671 provided to the rear side of the drum unit 518 when the optical print head 105 is in the retracted position.

The way in which the end portion of the abutting pin 515 at the drum unit 518 side abuts the bushing 671 will be described with reference to FIGS. 7A1 through 7B2. A part equivalent to the bushing 671 is provided on the front side of the drum unit 518, the structure and functions thereof being the same as that of the bushing 671. The end portion of the abutting pin 514 at the drum unit 518 side abuts this part. The way in which the drum unit 518 end portion of the abutting pin 515 comes into contact with the bushing 671 will be described here.

It can be seen from FIGS. 7A1 and 7B1 that the portion where the link member 652 is attached to the holding member 505 is closer to the photosensitive drum 103 side from the one of the ends of the abutting pin 515 that is opposite to the replacement unit side (the side where the drum unit 518 is disposed), in the vertical direction (the direction in which the optical print head 105 moves between the exposure position and the retracted position, i.e., in the direction of reciprocal movement). The spring attaching position 662 to which the link member 652 is attached is disposed so as to not intersect the abutting pin 515 in the vertical direction. The portion where the link member 651 is attached to the holding member 505 also is closer to the photosensitive drum 103 side from the one of the ends of the abutting pin 514 that is opposite to the replacement unit side (the side where the drum unit 518 is disposed), in the vertical direction (the direction in which the optical print head 105 moves between the exposure position and the retracted position, i.e., in the direction of reciprocal movement), although omitted from illustration here. The spring attaching portion 661 where the link member 651 is attached is disposed so as to not intersect the abutting pin 514 in the vertical direction. Accordingly, the size of the exposing unit 500 in the vertical direction can be suppressed.

The second support portion 528 includes a second seating face 587, a restricting portion 128 that is an example of a first facing portion (first fitted portion), a first wall face 588, and a second wall face 589, as illustrated in FIGS. 7A2 and 7B2. The two wall faces (first wall face 588 and second wall face 589) are an example of a second facing portion (second fitted portion). The second facing portion (second fitted portion) is positioned closer to the drum unit 518 side than the first facing portion (first fitted portion). Both the first facing portion (first fitted portion) and the second facing portion (second fitted portion) are positioned downstream from the abutting pin 514 in a direction heading from one end side of the optical print head 105 in the longitudinal direction of the optical print head 105 toward the other end side. Note that while the first facing portion (first fitted portion) and the second facing portion (second fitted portion) are integrally formed and make up the second support portion 528 in the present embodiment, a configuration may be made where the first facing portion (first fitted portion) and the second facing portion (second fitted portion) are separate members that are attachable to each other. That is to say, the second support portion 528 may have a configuration that is divided into a member where the first facing portion (first fitted portion) is formed and a member where the second facing portion (second fitted portion) is formed.

The second seating face 587 is provided to the lower side of the holding member 505. The lower side of the holding member 505 moving from the exposure position toward the retracted position abuts the second seating face 587 and the first seating face 586 of the later-described first support portion 527 from above in the vertical direction, and thus the optical print head 105 is at the retracted position.

The restricting portion 128 is a recess formed in the second support portion 528 and having the shape of a box with one side open, being opened toward the front side. The restricting portion 128 is formed to the opposite side of the holding member 505 from the side where the drum unit 518 is situated, and is fit further from the rear side than the abutting pin 515, so that the abutting pin 515 is capable of vertical movement. The abutting pin 515 protruding from the lower side of the holding member 505 travels through a gap formed by the restricting portion 128 in a state of being fit to the restricting portion 128 with movement in the left-and-right direction being restricted, and vertically moves along with the holding member 505. This gap is formed from the rear side of the abutting pin 515 toward positions facing each other on both sides of the abutting pin 515 in the left-and-right direction.

The first support portion 527 also has a restricting portion 127 that is an example of a first facing portion (first fitted portion), although omitted from illustration here. The restricting portion 127 is a recess formed in the first support portion 527 and having the shape of a box with one side open, being opened toward the front side. The restricting portion 127 is disposed to the downstream side of the abutting pin 514 in the direction from the other end side of the optical print head 105 in the longitudinal direction of the optical print head 105 toward one end side (the direction from the rear side toward the front side). The abutting pin 514 is fit to the restricting portion 127 from the front side, so that the abutting pin 514 is capable of moving vertically. The abutting pin 514 protruding from the lower side of the holding member 505 travels through a gap formed by the restricting portion 127 in a state of being fit to the restricting portion 127 with movement in the left-and-right direction being restricted, and vertically moves along with the holding member 505. This gap is formed from the front side of the abutting pin 514 toward positions facing each other on both sides of the abutting pin 514 in the left-and-right direction.

The state where the abutting pin 514 (of abutting pin 515) and the restricting portion 127 (or restricting portion 128) are fit, as used in the present embodiment, indicates a state of fitting where the difference between the width in the left-and-right direction formed by the restricting portion 127 (or restricting portion 128) and the width in the left-and-right direction of the part of the abutting pin 514 (or abutting pin 515) moving through the restricting portion 127 (or restricting portion 128) is a gap of 10 μm or more but 30 μm or less. The restricting portion 128 (or restricting portion 127) is formed tapered with the thickness in the vertical direction being reduced near the abutting pin 514, to maximally reduce friction occurring due to contact with the abutting pin 515 (or abutting pin 514). Accordingly, the abutting pin 514 (abutting pin 515) can smoothly move vertically in the gap of the restricting portion 127 (restricting portion 128). Accordingly, movement of the holding member 505 that is integral with the abutting pin 515 and abutting pin 514 is restricted in the direction perpendicular (perpendicular direction) to both the front-and-rear direction (longitudinal direction of the holding member 505) and the direction of reciprocal movement (the direction in which the holding member 505 moves between the exposure position and the retracted position).

Figure 9A:
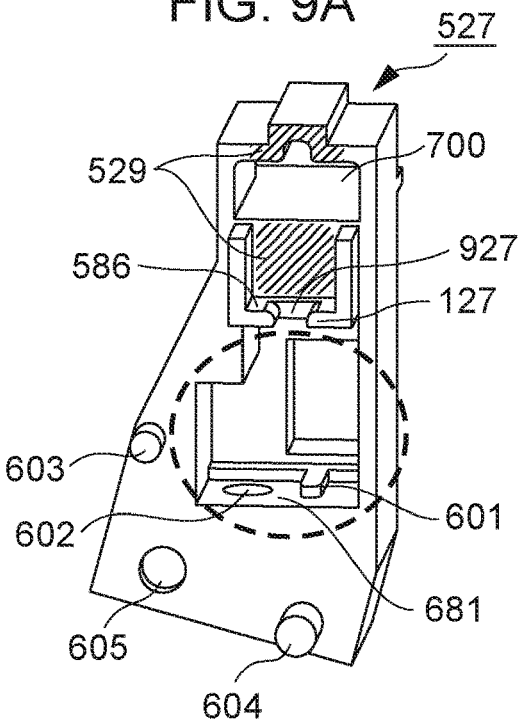
FIGS. 9A through 9C are perspective views of a first support portion and a third support portion.
Figure 9B:
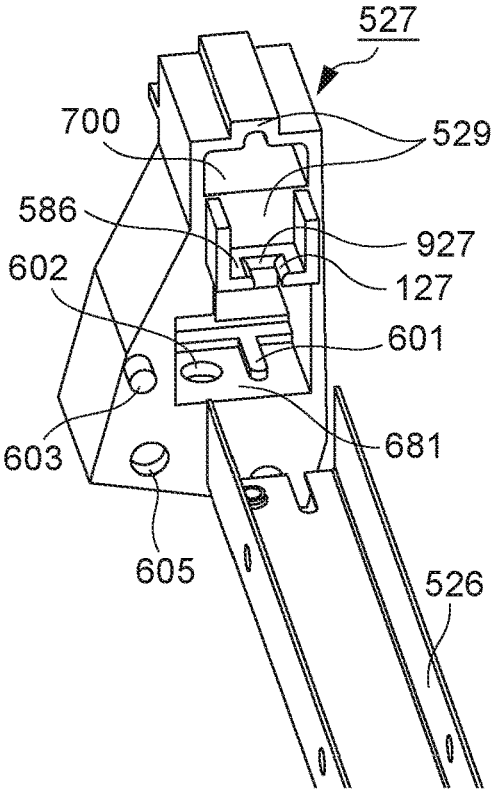
Figure 9C:
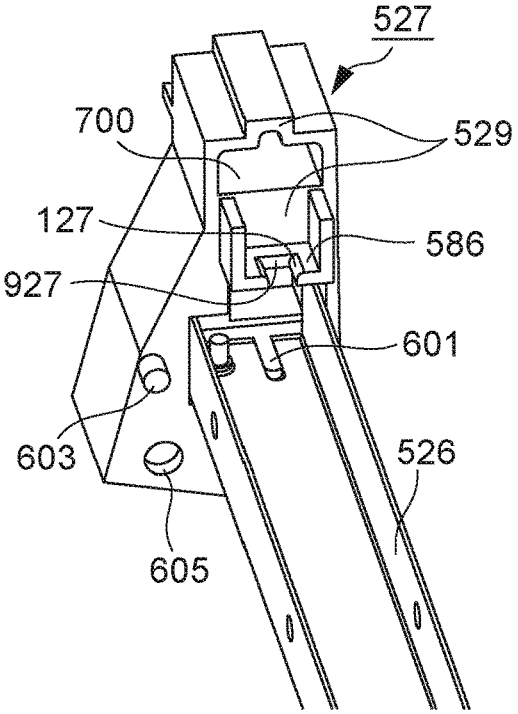
Figure 10A:
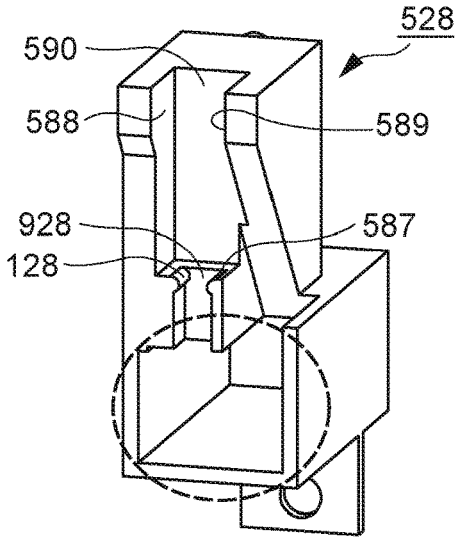
FIGS. 10A through 10C are perspective views of a second support portion, a rear-side plate, and an exposing unit attached to the second support portion.
Figure 10B:
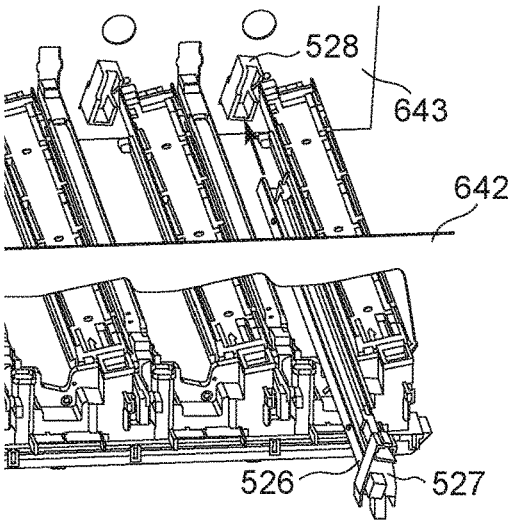
Figure 10C:
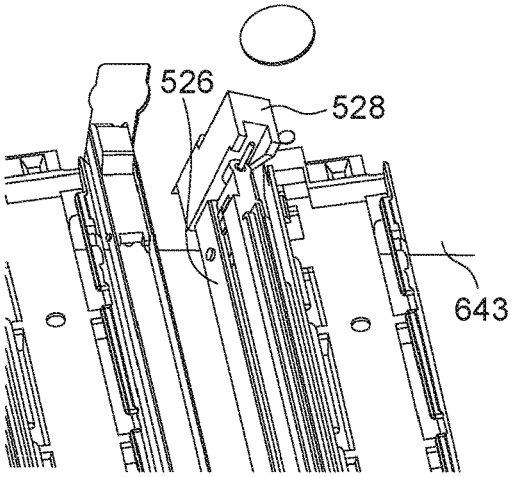

A facing face 927 is provided to the restricting portion 127, as illustrated in FIGS. 9A through 9C. The facing face 927 is a face that faces the holding member 505 in the front-and-rear direction. This facing face 927 restricts the abutting pin 514 from moving from the rear side to the front side. Also, a facing face 928 is provided to the restricting portion 128, as illustrated in FIGS. 10A through 10C. The facing face 928 is a face that faces the holding member 505 in the front-and-rear direction. This facing face 928 restricts the abutting pin 515 from moving from the front side to the rear side.

The first wall face 588 and second wall face 589 are disposed at positions facing each other in the left-and-right direction, with a gap formed. When the optical print head 105 reciprocally moves between the exposure position and the retracted position, the holding member 505 moves vertically through the gap formed by the first wall face 588 and second wall face 589 in a state of having been fit in this gap. During this time, movement of the holding member 505 is restricted in the direction perpendicular to (perpendicular direction) both the front-and-rear direction (longitudinal direction of the optical print head 105) and the vertical direction (the direction in which the optical print head 105 moves between the exposure position and the retracted position, i.e., in the direction of reciprocal movement), by the first wall face 588 and second wall face 589. In other words, the first wall face 588 and second wall face 589 face both left and right sides at one end side of the optical print head 105 in the longitudinal direction (both sides of the optical print head 105 in the perpendicular direction). A state where the holding member 505 is fit to a gap formed by the first wall face 588 and second wall face 589 as used in the present embodiment is a state of fitting a gap where the difference between the width of the gap in the left-and-right direction and the width at the rear side of the holding member 505 in the left-and-right direction is 0.5 mm or more but 2 mm or less.

According to the above configuration, the optical print head 105 moves between the exposure position and retracted position in a state where movement is restricted in the direction perpendicular to (perpendicular direction) both the front-and-rear direction (longitudinal direction of the optical print head 105) and the vertical direction (the direction in which the holding member 505 moves between the exposure position and the retracted position, i.e., in the direction of reciprocal movement). Note that it is sufficient for at least one of the restricting portion 127 and restricting portion 128 to be provided to the first support portion 527 or second support portion 528. That is to say, it is sufficient for the restricting portion 127 to be provided to the first support portion 527 that is an example of a support portion, or the restricting portion 128 to be provided to the second support portion 528.

The first wall face 588 and second wall face 589 may be provided to the first support portion 527 and not the second support portion 528. In this case, the first wall face 588 and second wall face 589 are positioned downstream from the abutting pin 514 in the direction heading from the other end side of the optical print head 105 toward the one end side (direction from the rear side toward the front side).

The position at which the abutting pin 515 comes into contact with the bushing 671 provided to the rear side of the drum unit 518, and the abutting pin 514 (omitted from illustration) comes into contact with the part equivalent to the bushing 671 that is provided to the front side of the drum unit 518, is the exposure position of the optical print head 105, as illustrated in FIGS. 7A1 and 7A2. The distance between the lens array 506 and the surface of the photosensitive drum 103 becomes the designed nominal distance by the abutting pin 514 and the abutting pin 515 abutting the bushing 671 and the part equivalent to the bushing 671.

Note that the optical print head 105 that has moved to the exposure position is situated further toward the drum unit 518 side than the gap formed by the first wall face 588 and second wall face 589. That is to say, movement of the optical print head 105 situated at the exposure position in the perpendicular direction (direction perpendicular to both the longitudinal direction of the optical print head 105 and the direction in which the optical print head 105 moves between the exposure position and the retracted position) is not restricted by the first wall face 588 and second wall face 589.

On the other hand, the position where the abutting pin 515 is retracted from the bushing 671 provided to the rear side of the drum unit 518, as illustrated in FIGS. 7B1 and 7B2 is equivalent to the retracted position of the optical print head 105. The optical print head 105 is in a state where the drum unit 518 that moves by sliding for being replaced and the optical print head 105 do not come into contact, by the optical print head 105 being at the retracted position illustrated in FIGS. 7B1 and 7B2.

Figure 8:
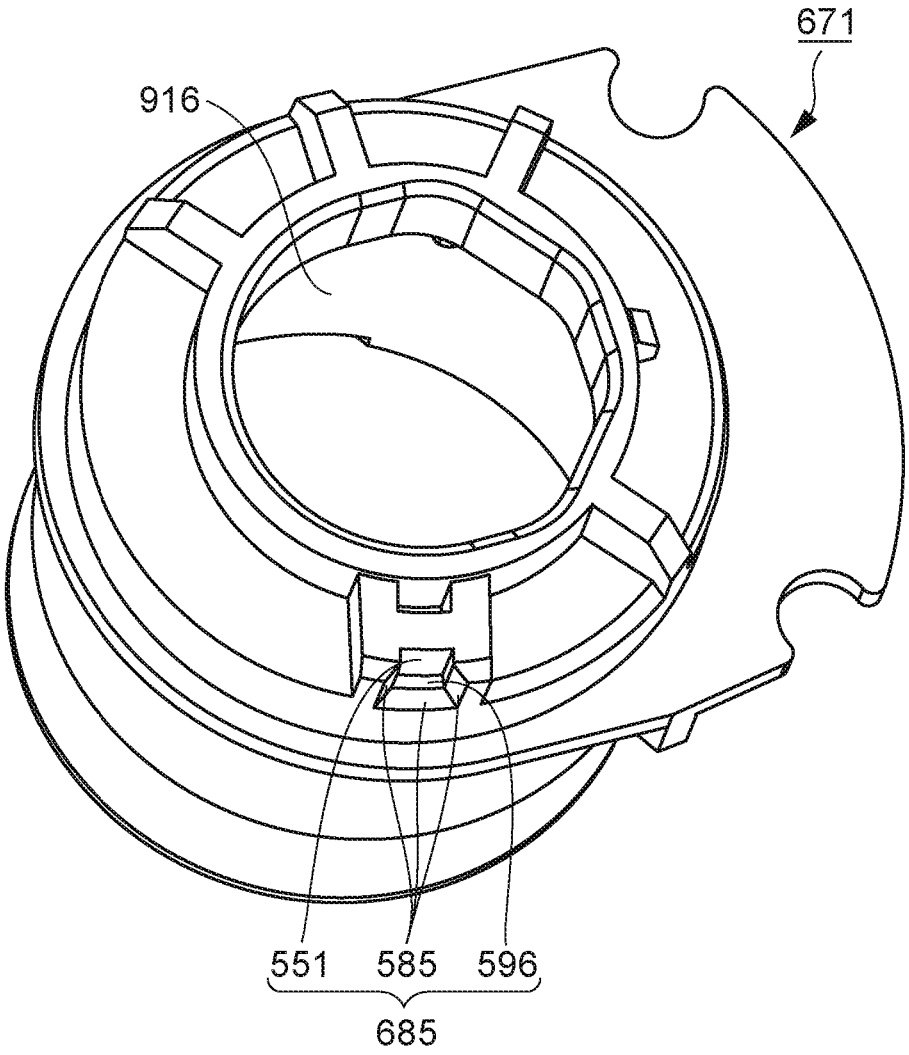
FIG. 8 is a perspective view of a bushing attached to the rear side of a drum unit.

Now, the bushing 671 that the drum unit 518 has will be described. FIG. 8 illustrates a perspective view of the bushing 671. The bushing 671 is a member fixed to the casing of the drum unit 518 by screws or adhesive agent. An opening 916 is formed in the bushing 671, as illustrated in FIG. 8. A shaft member at the other end side of the photosensitive drum 103 is rotatably inserted into the opening 916. That is to say, the bushing 671 rotatably bears the photosensitive drum 103.

The photosensitive drum 103 has a photosensitive layer formed on an outer wall face of a hollow cylindrical aluminum tube. Flanges 673 are press-fitted to both ends of the aluminum tube. The flange 673 at the other end side of the photosensitive drum 103 is rotatably inserted into the opening 916 formed in the bushing 671. The flange 673 rotates while rubbing against the inner wall face of the opening 916 formed in the bushing 671. That is to say, the bushing 671 rotatably bears the photosensitive drum 103. An opening the same as that of the bushing 671 is also formed at the middle portion of the part equivalent to the bushing 671 provided to the front side of the drum unit 518, with which the abutting pin 514 comes into contact. The flange 673 of the one end side (front side) of the photosensitive drum 103 is rotatably inserted into the opening formed in the part equivalent to the bushing 671. The flange 673 rotates while rubbing against the inner wall face of this opening. That is to say, the part equivalent to the bushing 671 rotatably bears the photosensitive drum 103 at the front side, the same as the rear side of the drum unit 518.

The bushing 671 has a fitting portion 685 (abutting portion) to which the abutting pin 515 fits. The fitting portion 685 is provided with an abutting face 551, a rear-side wall face 596, and a tapered portion 585. The fitting portion 685 may be recessed as to the bushing 671, or may be erected. The abutting pin 515 that moves in the direction from the retracted position toward the exposure position abuts the abutting face 551. The lower edge of the fitting portion 685 has the tapered portion 585 formed, that is tapered. The tapered portion 585 guides movement of the abutting pin 515 heading from the retracted position toward the exposure position, so as to abut the abutting face 551. Contact of the rear-side wall face 596 and the abutting pin 515 will be described later.

The movement of the abutting pin 515 that has abutted the abutting face 551 of the fitting portion 685 is restricted in directions intersecting both the front-and-rear direction (rotational axis direction of the photosensitive drum 103) and the vertical direction (the direction in which the optical print head 105 moves between the exposure position and the retracted position, i.e., in the direction of reciprocal movement) by the fitting portion 685. That is to say, movement of the upper end of the abutting pin 515 is restricted in directions intersecting both the front-and-rear direction and the vertical direction by fitting to the fitting portion 685, and movement of the lower end of the abutting pin 515 is restricted in directions intersecting both the front-and-rear direction and the vertical direction by fitting to the gap formed by the restricting portion 128, with regard to the optical print head 105 situated at the exposure position (FIG. 7A2). Now, the difference between the width of the fitting portion 685 in the left-and-right direction and the width of the upper end of the abutting pin 515 in the left-and-right direction, and the difference between the width of the gap formed by the restricting portion 128 in the left-and-right direction and the width of the lower end of the abutting pin 515 in the left-and-right direction, are smaller than the difference between the width in the left-and-right direction of the first wall face 588 and second wall face 589, and the width in the left-and-right direction of the holding member 505 situated between the first wall face 588 and second wall face 589. Accordingly, when the optical print head 105 is at the exposure position, the first wall face 588 and second wall face 589 do not contribute to restriction of movement of the holding member 505 in directions intersecting either of the front-and-rear direction and the vertical direction. Note that it is not necessary for the first wall face 588, second wall face 589, and holding member 505 to be in non-contact when the optical print head 105 is at the exposure position. A structure is sufficient where the movement of the holding member 505 in the left-and-right direction is not restricted by the first wall face 588 and second wall face 589, by the first wall face 588 and second wall face 589 being elastically deformable members or the like.

Movement Mechanism

The movement mechanism 640 for moving the optical print head 105 will be described next. First, the first support portion 527 will be described. FIG. 9A is a schematic perspective view of the first support portion 527. Formed on the first support portion 527 are the first seating face 586 that is an example of an abutting portion (stopping mechanism), an opening 700 serving as an example of an insertion portion, an abutting portion 529, restricting portion 127, protrusion 601, screw hole 602, positioning boss 603, positioning boss 604, and screw hole 605. The first support portion 527 may be an article where the opening 700 and first seating face 586 have been integrally formed by injection molding, or these may be separate members.

The first seating face 586 is a portion where the lower side of the holding member 505 moving from the exposure position toward the retracted position abuts from above in the vertical direction, and is fixed to the main body of the image forming apparatus 1. The lower side of the holding member 505 abuts the first seating face 586, and the optical print head 105 is at the retracted position.

A cleaning member 572 for cleaning the light-emitting face of the lens array 506 contaminated by toner or the like is inserted through the opening 700 from the outer side of the main body of the image forming apparatus 1. The cleaning member 572 is a slender rod-like member. Although a through hole which the cleaning member 572 passes through in the front-and-rear direction is illustrated as an example of the opening 700 in the present embodiment, this is not restricted to being a hole, and a slit may be formed above, for example. The abutting portion 529 is a rear-side face of the first support portion 527, as indicated by hatching in FIG. 9A, and is regions above and below the opening 700. The function of the abutting portion 529 will be described later.

The restricting portion 127 is a recess formed in the first support portion 527 and having the shape of a box with one side open, being opened toward the rear side, as illustrated in FIG. 9A. Part of the abutting pin 514 protruding from the lower side of the holding member 505 moves vertically along with the holding member 505 through the gap formed by the restricting portion 127. The restricting portion 127 is formed tapered, with the thickness in the vertical direction being smaller the closer to the abutting pin 514, to maximally reduce friction occurring due to contact with the abutting pin 514. Accordingly, the abutting pin 514 can smoothly move vertically in the gap of the restricting portion 127.

The first support portion 527 is fixed to the front-side face of the front-side plate 642. Multiple holes (omitted from illustration), corresponding to the positioning boss 603, positioning boss 604, and fixing screws are formed in the front-side plate 642. The positioning boss 603 and positioning boss 604 are inserted into respective holes of the multiple holes provided to the front-side plate 642, and in this state, the first support portion 527 is fixed to the front-side plate 642 by screws passed through the screw holes of the first support portion 527.

The third support portion 526, which will be described later, is sheet metal folded into the shape of a box with one side opened. FIG. 9B is a diagram for describing the way in which one end portion of the third support portion 526 in the longitudinal direction is inserted into the portion surrounded by a dotted line in FIG. 9A. FIG. 9C is a diagram illustrating the one end portion of the third support portion 526 in the longitudinal direction having been inserted into the portion surrounded by the dotted line in FIG. 9A. A notch is provided at the one end portion of the third support portion 526 as illustrated in FIGS. 9B and 9C, with the protrusion 601 of the first support portion 527 side engaging the notch of the third support portion 526. This engaging of the protrusion 601 with the notch in the third support portion 526 positions the third support portion 526 as to the first support portion 527 in the left-and-right direction. The third support portion 526 is pressed from the lower side in FIG. 9C by the screw inserted from the screw hole 602, and is fixed to the first support portion 527 by abutting a contact face 681 of the first support portion 527.

Next, the second support portion 528 will be described. FIG. 10A is a schematic perspective view of the second support portion 528. The second seating face 587, first wall face 588, second wall face 589, a third wall face 590, and the restricting portion 128, are formed on the second support portion 528. The second seating face 587 is the portion that the lower side of the holding member 505 moving from the exposure position toward the retracted position abuts, as described earlier. The second seating face 587 is fixed to the main body of the image forming apparatus 1. The lower side of the holding member 505 abuts the second seating face 587, and thus the optical print head 105 is at the retracted position.

The second support portion 528 is fixed to the front-side face of the rear-side plate 643, as illustrated in FIG. 10B. The second support portion 528 is fixed to the rear-side plate 643 by positioning bosses and screws, in the same way that the first support portion 527 is fixed to the front-side plate 642. FIG. 10C illustrates a state where the other end side (rear side) of the third support portion 526 in the longitudinal direction of the third support portion 526 is inserted into the portion surrounded by a dotted line in FIG. 10A. That is to say, one end portion of the third support portion 526 is supported by the first support portion 527, and the other end portion is supported by the second support portion 528, with the first support portion 527 and the second support portion 528 being fixed to the front-side plate 642 and rear-side plate 643, respectively. In other words, the third support portion 526 is fixed to the main body of the image forming apparatus 1.

Note that an arrangement may be made where the second support portion 528 is fixed to the third support portion 526 by screws or the like, and is not fastened to the rear-side plate 643 by screws. In this case, a structure is made, for example, where a recessed portion is formed in the second support portion 528, which fits with a protruding portion formed on the rear-side plate 643, thereby positioning the second support portion 528 as to the rear-side plate 643. The first wall face 588 and second wall face 589 of the second support portion 528 will be described later.

The restricting portion 128 is a recess formed in the second support portion 528 and having the shape of a box with one side open, being opened toward the front side, as illustrated in FIG. 10A. Part of the abutting pin 515 protruding from the lower side of the holding member 505 moves vertically along with the holding member 505 through the gap formed by the restricting portion 128. The restricting portion 128 is formed tapered, to maximally reduce friction occurring due to contact with the abutting pin 515 with the thickness in the vertical direction being thinner, the closer to the abutting pin 515. Accordingly, the abutting pin 515 can smoothly move vertically in the gap of the restricting portion 128.

The third wall face 590 restricts the holding member 505 from moving to the rear side. The third wall face 590 (facing face) is a face that faces the holding member 505 in the front-and-rear direction (longitudinal direction of the optical print head 105). Movement of the holding member 505 in the direction from the front side toward the rear side is restricted by the third wall face 590. The third wall face 590 along with the first wall face 588 and second wall face 589 may be referred to as the second facing portion (second fitted portion).

In a case of a configuration where the first wall face 588 and second wall face 589 are provided to the first support portion 527, the holding member 505 is restricted from moving forward by the abutting portion 529 (facing face). The abutting portion 529 is a face that faces the holding member 505 in the front-and-rear direction (longitudinal direction of the optical print head 105). Movement of the holding member 505 in the direction from the rear side toward the front side is restricted by the abutting portion 529.

Next, the third support portion 526 and sliding portion 525 will be described with reference to FIGS. 11*a* and 11B. The third support portion 526 and sliding portion 525 are disposed on the opposite side of the holding member 505 from the photosensitive drum 103.

Figure 11A:
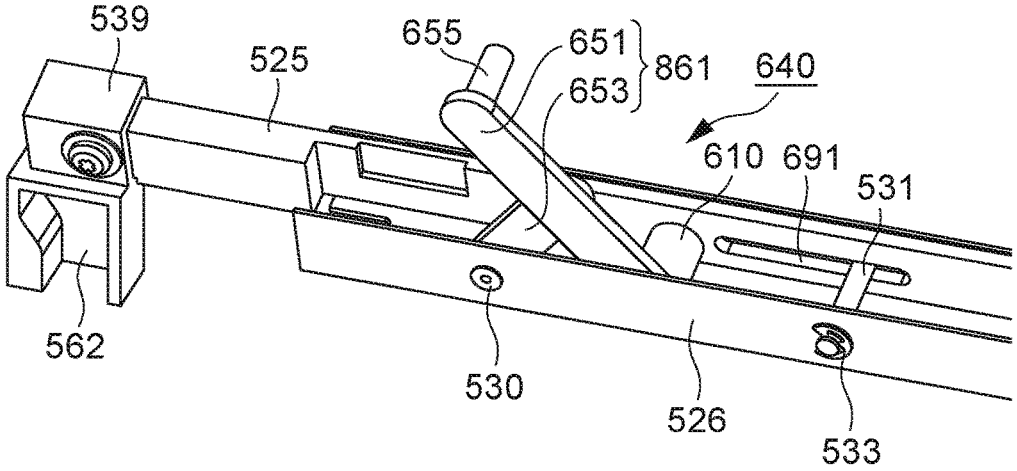
FIGS. 11A and 11B are perspective views of a movement mechanism, with the first support portion omitted from illustration.
Figure 11B:
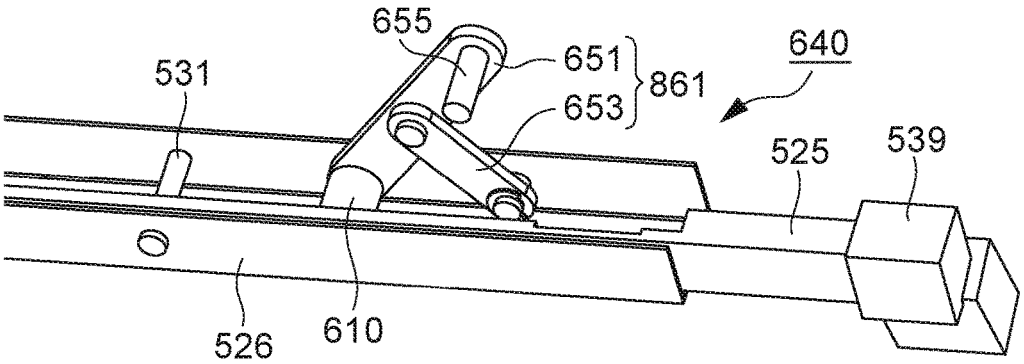

FIG. 11A is a schematic perspective view of the front side of the movement mechanism 640 as viewed from the left side, with the first support portion 527 omitted from illustration. FIG. 11B is a schematic perspective view of the front side of the movement mechanism 640 as viewed from the right side, with the first support portion 527 omitted from illustration. The movement mechanism 640 has the link member 651, the sliding portion 525, and the third support portion 526. The third support portion 526 has a support shaft 531 and an E-type snap ring 533. It can be seen from FIGS. 11A and 11B that the support shaft 531 is inserted through openings formed in the opposing faces (left-side face and right-side face) of the third support portion 526 that has been formed into the shape of a box with one side open. The support shaft 531 passes through the right-side face and the left-side face of the third support portion 526. The support shaft 531 is retained by the E-type snap ring 533 on the outer side of the left-side face, so as not to fall out from the openings of the third support portion 526. On the other hand, a slot 691 that is an elongated opening and that extends in the front-and-rear direction is formed in the sliding portion 525, as illustrated in FIG. 11A. The support shaft 531 is inserted through the slot 691 of the sliding portion 525, and is loosely fit with a gap of around 0.1 to 0.5 mm as to the slot 691 in the vertical direction, for example. Accordingly, movement of the sliding portion 525 in the vertical direction as to the third support portion 526 is restricted, and the sliding portion 525 can only move by sliding as to the third support portion 526 by the length of the slot 691 in the front-and-rear direction.

A slide aiding member 539 having an accommodation space 562 from the left side to the lower side is attached to one end side of the sliding portion 525. The slide aiding member 539 is fixed to the sliding portion 525 by being fastened by a screw from the left side. The accommodation space 562 accommodates a later-described pressing member 561, serving as an example of a pressing portion, that the cover 558 has. The relation between the accommodation space 562 and the pressing member 561, and structural features thereof, will be described later along with description of the cover 558.

The movement mechanism 640 will be described with reference to FIGS. 3 and 11A through 12B. FIG. 3 is a schematic perspective view of the exposing unit 500 having the movement mechanism 640. The movement mechanism 640 has the first link mechanism 861, second link mechanism 862, sliding portion 525, first support portion 527, second support portion 528, and third support portion 526, as illustrated in FIG. 3. The first link mechanism 861 includes the link member 651 and link member 653, and the second link mechanism 862 includes the link member 652 and link member 654. The link member 651 and link member 653, and link member 652 and link member 654, each make up a λ-type link mechanism, as illustrated in FIG. 3.

FIG. 11A is a schematic perspective view of the front side of the movement mechanism 640, as viewed from the left side, with the first support portion 527 omitted from illustration. FIG. 11B is a schematic perspective view of the front side of the movement mechanism 640, as viewed from the right side, with the first support portion 527 omitted from illustration.

Figure 12A:
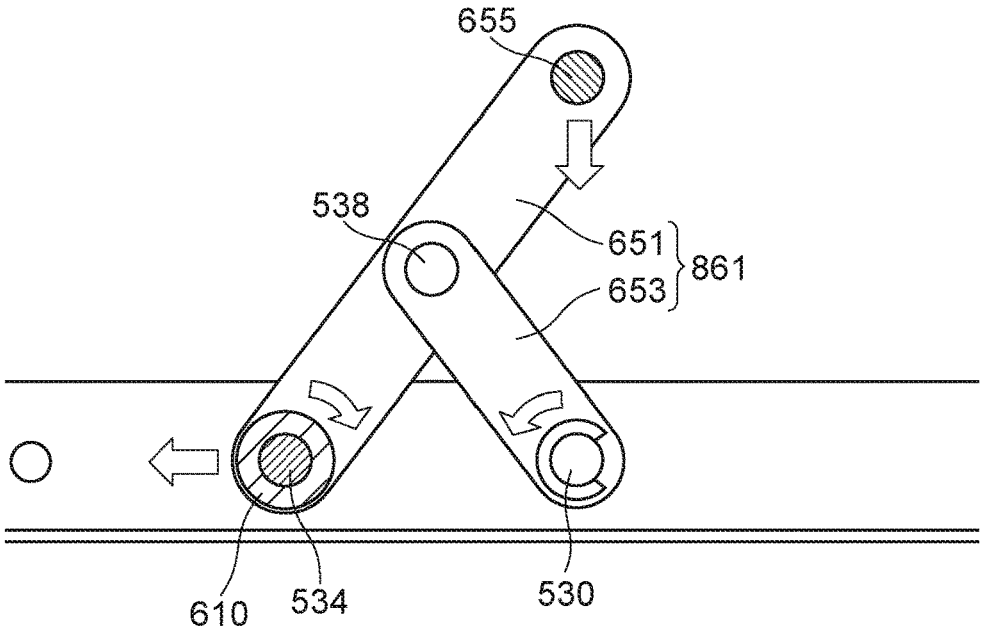
FIGS. 12A and 12B are side views of a A-type first link mechanism.
Figure 12B:
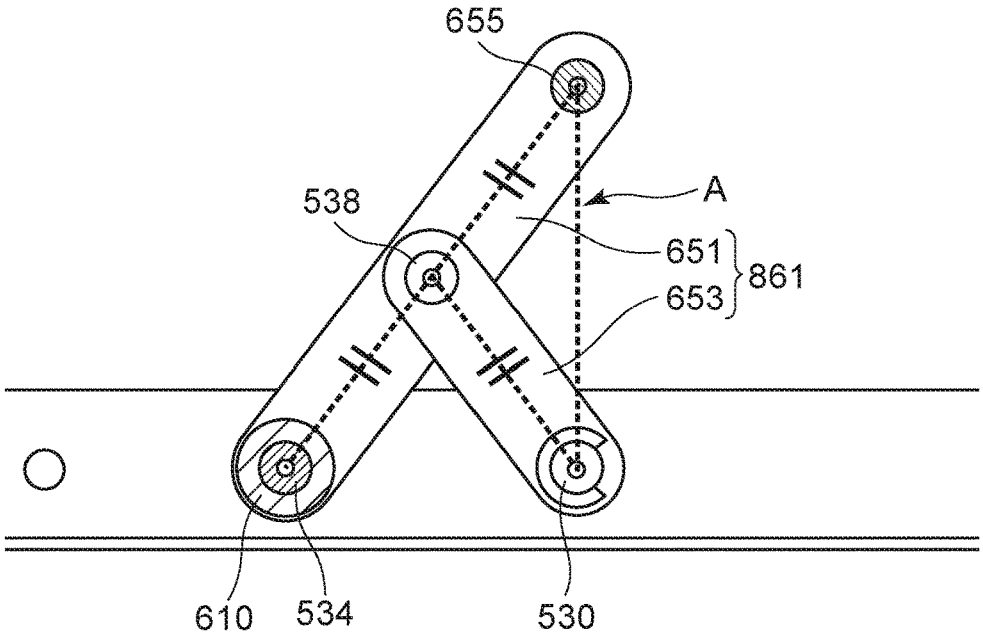

The first link mechanism 861 will be described with reference to FIGS. 11A through 12B. FIG. 12A is a diagram where a cross-sectional view of the first link mechanism 861 taken along the rotational axis of the photosensitive drum 103 is viewed from the right side. The first link mechanism 861 has the link member 651 and link member 653. The link member 651 and link member 653 making up the first link mechanism 861 are each single link members, but may be configured by combining multiple link members. The length of the link member 653 in the longitudinal direction is shorter than the length of the link member 651 in the longitudinal direction, as illustrated in FIGS. 12A and 12B.

The link member 651 has a bearing 610, a protrusion 655, and a connecting shaft portion 538. The bearing 610 is provided to one end side in the longitudinal direction of the link member 651. The protrusion 655 is a cylindrical protrusion erected in the pivoting axis direction of the link member 651 provided at the other end side in the longitudinal direction of the link member 651, for causing deformation of a spring provided to the holding member 505 side of the optical print head 105. The connecting shaft portion 538 is provided between the bearing 610 and protrusion 655 in the longitudinal direction of the link member 651. Although the protrusion 655 serves as a first moving portion, the first moving portion is not restricted to the protrusion 655, and may be a structure where one end side in the longitudinal direction of the link member 651 is bent in the pivoting axis direction.

A circular hollowed space that extends in the left-and-right direction in FIG. 12A is formed in the bearing 610, as a hole. A fitting shaft portion 534 is provided to the sliding portion 525. The fitting shaft portion 534 is a cylindrical protrusion erected from the sliding portion 525 to the left direction in FIG. 12A. The fitting shaft portion 534 forms a first connecting portion by being pivotably fit to the hole of the bearing 610. That is to say, the link member 651 is capable of pivoting as to the sliding portion 525, with the first connecting portion as the center of pivoting. Note that the fitting shaft portion 534 may be formed on the link member 651 side, and the bearing 610 formed on the sliding portion 525.

The link member 653 has a connecting shaft portion 530. The connecting shaft portion 530 is provided to one end side in the longitudinal direction of the link member 653. The connecting shaft portion 530 is a cylindrical protrusion erected from the link member 653 to the left side in FIG. 12A. The connecting shaft portion 530 is rotatably inserted into a hole formed in the third support portion 526, and thus forms a third connecting portion. The connecting shaft portion 530 may be formed to the third support portion 526 rather than the link member 653. That is to say, the connecting shaft portion 530 formed on the third support portion 526 may be inserted to a hole formed in the link member 653.

A circular hole that extends in the left-and-right direction in FIG. 12A is formed at the other end side in the longitudinal direction of the link member 653. The connecting shaft portion 538 of the link member 651 is pivotably inserted into this hole, whereby the connecting shaft portion 538 and the hole of the link member 653 make up a fourth connecting portion. That is to say, the link member 653 is capable of pivoting as to the third support portion 526 with the third connecting portion as a center of pivoting, and is capable of pivoting as to the link member 651 with the fourth connecting portion as a center of pivoting. Now, the connecting shaft portion 538 may be formed on the link member 653 rather than the link member 651. That is to say, the connecting shaft portion 538 formed on the link member 653 may be inserted into a hole formed in the link member 651.

Note that the configuration of the second link mechanism 862 is the same as the configuration of the first link mechanism 861 described above. The link member 652 and link member 654 that the second link mechanism 862 has correspond to the link member 651 and link member 653, respectively. The one end side in the longitudinal direction of the link member 652 and the connecting portion of the sliding portion 525 make up a second connecting portion, corresponding to the first connecting portion. A protrusion 656 corresponding to the protrusion 655 of the link member 651 is formed on the link member 652, as an example of a moving portion. Note that one of the link member 653 and link member 654 may be omitted from the embodiment regarding the movement mechanism 640.

According to the above configuration, when the sliding portion 525 moves by sliding from the front side toward the rear side with regard to the third support portion 526, the bearing 610 to which the fitting shaft portion 534 has been fit moves by sliding from the front side toward the rear side as to the third support portion 526, along with the sliding portion 525. Accordingly, when viewing the first link mechanism 861 from the right side as illustrated in FIG. 12A, the link member 651 pivots in the clockwise direction with the fitting shaft portion 534 as the center of pivoting, and the link member 653 pivots in the counter-clockwise direction with the connecting shaft portion 530 as the center of pivoting. Accordingly, the protrusion 655 moves in a direction from the exposure position toward the retracted position.

On the other hand, when the sliding portion 525 moves by sliding from the rear side toward the front side as to the third support portion 526, the link member 651 and link member 653 move in the opposite directions as to the arrows in FIG. 12A. When the sliding portion 525 moves by sliding from the rear side toward the front side with regard to the third support portion 526, the bearing 610 to which the fitting shaft portion 534 has been fit moves by sliding from the rear side toward the front side as to the third support portion 526, along with the sliding portion 525. Accordingly, when viewing the first link mechanism 861 from the right side as illustrated in FIG. 12A, the link member 651 pivots in the counter-clockwise direction with the fitting shaft portion 534 as the center of pivoting, and the link member 653 pivots in the clockwise direction with the connecting shaft portion 530 as the center of pivoting. Accordingly, the protrusion 655 moves in a direction from the retracted position toward the exposure position.

Now, (1) the distance between the pivoting center axis of the connecting shaft portion 538 and the pivoting center axis of the bearing 610 will be referred to as L1, (2) the distance between the pivoting center axis of the connecting shaft portion 538 and the pivoting center axis of the connecting shaft portion 530 will be referred to as L2, and (3) the distance between the pivoting center axis of the connecting shaft portion 538 and the pivoting center axis of the protrusion 655 will be referred to as L3. In the movement mechanism 640, the first link mechanism 861 forms a Scott Russel linkage where L1, L2, and L3 are equal (see FIG. 12B). The protrusion 655 moves perpendicular (along line A in FIG. 12B) to the direction of sliding movement of the fitting shaft portion 534 due to the distances L1, L2, and L3 being equal, so the optical print head 105 can be moved generally in the optical axis direction in the above-described link mechanism.

A configuration may be made where the front-and-rear directions of the first link mechanism 861 and second link mechanism 862 are opposite, so that when the sliding portion 525 is moved by sliding from the front side toward the rear side, the optical print head 105 moves from the retracted position toward the exposure position, and when the sliding portion 525 is moved by sliding from the rear side toward the front side, the optical print head 105 moves from the exposure position toward the retracted position. In this case, the later-described cover 558 presses the sliding portion 525 from the front side toward the rear side when moving from an opened state to a closed state, and pulls the sliding portion 525 from the rear side toward the front side when moving from a closed state to an opened state.

The mechanism for moving optical print head 105 is not restricted to the movement mechanism 640. A movement mechanism 140 illustrated in FIGS. 13A and 13B may be used. The movement mechanism 140 will be described below with reference to FIGS. 13A through 14B. Members which have substantially the same functions as the members making up the movement mechanism 640 are denoted by the same reference numerals, and redundant description may be omitted.

The arrangement by which the movement mechanism 140 moves the holding member 505 will be described with reference to FIGS. 13A through 14B. FIG. 14A is a cross-sectional view of the holding member 505 and the movement mechanism 140 illustrated in FIG. 14B, taken along the rotational axis of the photosensitive drum 103.

Figure 13A:
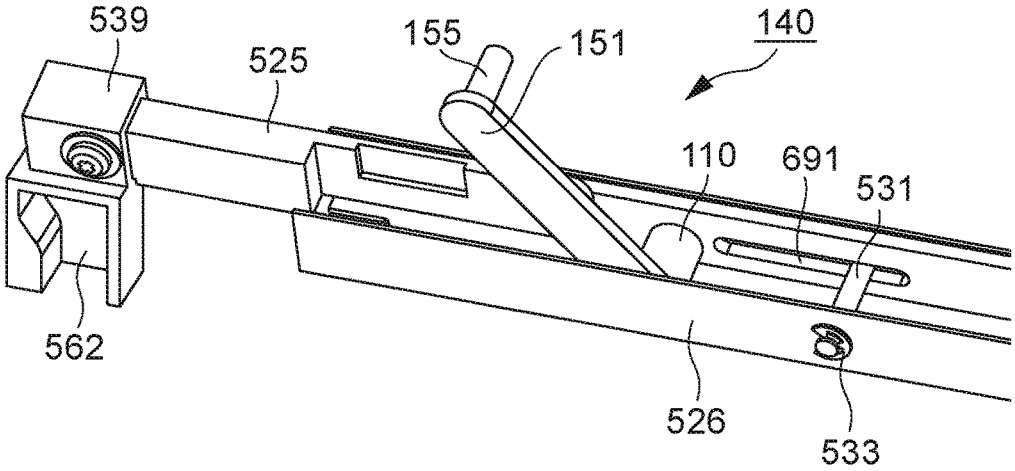
FIGS. 13A and 13B are perspective views of a movement mechanism, with the first support portion omitted from illustration.
Figure 13B:
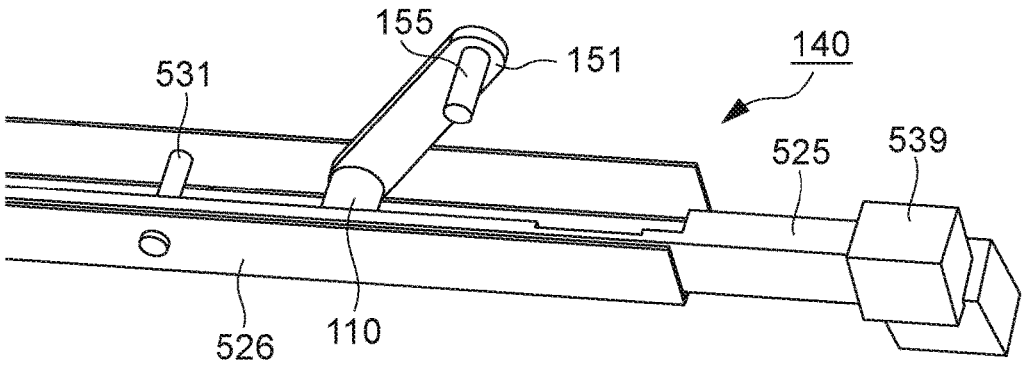
Figure 14A:
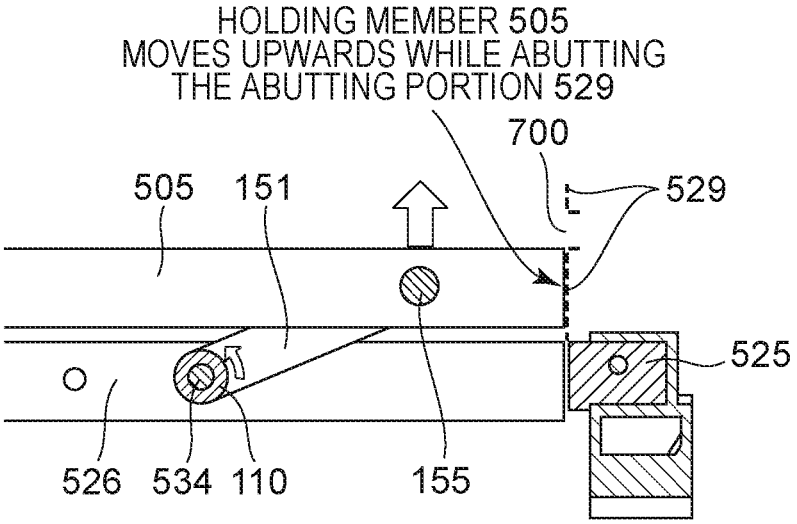
FIGS. 14A and 14B are diagrams describing a movement mechanism.
Figure 14B:
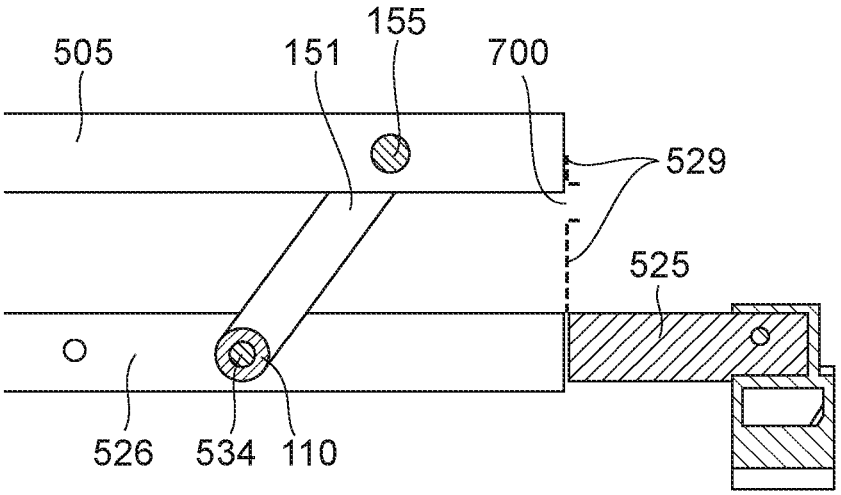

The link member 151 has a bearing 110 and a protrusion 155, as illustrated in FIGS. 13A and 13B. The bearing 110 is provided at the one end side of the link member 151 in the longitudinal direction. The protrusion 155 is, as illustrated in FIGS. 14A and 14B, provided on the other end side of the link member 151 in the longitudinal direction, and is a cylindrical protrusion that is erected in the pivoting axis direction of the link member 151, and deforms a spring provided on the holding member 505 side of the optical print head 105. Note that the moving portion is not restricted to being the protrusion 155, and may be a structure where the one end side of the link member 151 in the longitudinal direction is bent in the pivoting axis direction of the link member 151.

A circular hollowed space that extends in the left-and-right direction is formed in the bearing 110, as a hole. A fitting shaft portion 534 is provided to the sliding portion 525, as illustrated in FIGS. 14A and 14B. The fitting shaft portion 534 is a cylindrical protrusion erected from the sliding portion 525 toward the left. The hole of the bearing 110 is fit with the fitting shaft portion 534 so as to be capable of pivoting, thereby forming a first connecting portion. That is to say, the link member 151 is pivotable as to the sliding portion 525, with the first connecting portion as the center of pivoting. Note that an arrangement may be made where the fitting shaft portion 534 is formed on the link member 151 side, and the bearing 110 is formed on the sliding portion 525.

Note that a shaft the same as the support shaft 531 is provided at the rear side of the third support portion 526, a slot the same as the slot 691 is formed at the rear side of the sliding portion 525, and the structure of the rear side of the movement mechanism 140 is the same as the front side. The structure of the link member 152 also is the same as the link member 151. The connecting portion of the one end side of the link member 152 in the longitudinal direction and the sliding portion 525 make up the second connecting portion, corresponding to the first connecting portion.

The abutting portion 529 of the first support portion 527 (omitted from illustration in FIGS. 13A through 14B) is disposed further toward the front side as compared to the one end of the holding member 505. Accordingly, when the sliding portion 525 moves by sliding as to the third support portion 526 from the rear side to the front side, the bearing 110 to which the fitting shaft portion 534 is fit also moves by sliding as to the third support portion 526 from the rear side to the front side, along with the sliding portion 525. The holding member 505 to which the protrusion 155 is attached also attempts to move toward the front side in conjunction with this, but the one end of the holding member 505 is abutting the abutting portion 529, and accordingly movement toward the front side is restricted. The link member 151 is disposed intersecting the rotational axis direction of the photosensitive drum 103 such that the one end side having the protrusion 155 is situated closer to the drum unit 518 side as compared to the other end side having the bearing 110, and accordingly pivots in a counter-clockwise direction with the fitting shaft portion 534 as the center of pivoting, as viewed from the right side as illustrated in FIG. 14A. Accordingly, the holding member 505 moves from the retracted position toward the exposure position with the one end of the holding member 505 abutting the abutting portion 529.

On the other hand, when the sliding portion 525 moves by sliding as to the third support portion 526 from the front side to the rear side, the bearing 110 fit to the fitting shaft portion 534 moves by sliding as to the third support portion 526 from the rear side to the front side, along with the sliding portion 525. Accordingly, the link member 151 pivots in a clockwise direction with the fitting shaft portion 534 as the center of pivoting, as viewed from the right side as illustrated in FIG. 14A. Thus, the protrusion 155 moves in a direction from the exposure position toward the retracted position. The sliding portion 525 moves from the rear side to the front side in conjunction with a closing operation of the cover 558, and moves from the front side to the rear side in conjunction with an opening operation of the cover 558, which will be described in detail later. That is to say, when the cover 558 moves from an opened state to a closed state, the holding member 505 moves in a direction from the retracted position toward the exposure position, and when the cover 558 moves from the closed state to the opened state, the holding member 505 moves in a direction from the exposure position toward the retracted position.

The mechanism for moving the optical print head 105 is not restricted to the movement mechanism 140 and movement mechanism 640. A movement mechanism 840 illustrated in FIGS. 15A1 through 15B may be used. The movement mechanism 840 will be described below with reference to FIGS. 15A1 through 15B. Note that members having substantially the same functions as members making up the movement mechanism 140 (640) are denoted by the same reference numerals, and redundant description may be omitted.

FIGS. 15A1 and 15A2 illustrate the movement mechanism 840. The movement mechanism 840 includes a first link mechanism 858, a second link mechanism 859, sliding portion 825, and the third support portion 526, as illustrated in FIGS. 15A1 and 15A2. The first link mechanism 858 includes a link member 843 and a link member 844, and the second link mechanism 859 includes a link member 845 and a link member 846. The link member 843 and link member 844, and the link member 845 and link member 846, each pivotably intersect each other, making up an X-shaped link mechanism as illustrated in FIGS. 15A1 through 15B. A protrusion 847 of the link member 843, a protrusion 848 of the link member 844, a protrusion 849 of the link member 845, and a protrusion 850 of the link member 846, are each pivotably attached to a holding member 805 that is omitted from illustration. When a sliding portion 825 is moved by sliding in the direction of the arrow A in FIG. 15A1, the link members 843 through 846 pivot with regard to the sliding portion 825, and the protrusions 847 through 850 move downwards (FIG. 15A2). On the other hand, when the sliding portion 825 is moved by sliding in the direction of the arrow B in FIG. 15A2, the link members 843 through 846 pivot with regard to the sliding portion 825, and the protrusions 847 through 850 move upwards (FIG. 15A1).

FIG. 15B is a diagram illustrating the front side of the movement mechanism 840 with the front side of the holding member 805. The arrangement by which the movement mechanism 840 moves the holding member 805 will be described below with reference to FIG. 15B. Now, the operations of the first link mechanism 858 and second link mechanism 859 are substantially the same, so the first link mechanism 858 will be described here with reference to FIG. 15B. The first link mechanism 858 has the link member 843 and link member 844. The link member 843 and link member 844 making up the first link mechanism 858 are single members, but may be configured by combining multiple members.

The movement mechanism 840 in FIG. 15B has the first link mechanism 858 and sliding portion 825. The sliding portion 825 has a slot 863 that is an elongated opening, passing through the sliding portion 825 in the left-and-right direction and extending in the front-and-rear direction, as illustrated in FIG. 15B.

The link member 843 has a protrusion 810, the protrusion 847, and the connecting shaft portion 538. The protrusion 810 is provided to one end side in the longitudinal direction of the link member 843. The protrusion 847 is a cylindrical protrusion erected to the right side in the pivoting axial direction of the link member 843, provided to the other end side in the longitudinal direction of the link member 843. The connecting shaft portion 538 is provided between the protrusion 810 and protrusion 847 in the longitudinal direction of the link member 843. Although the protrusion 847 serves as a first moving portion, the first moving portion is not restricted to the protrusion 847, and may be a structure where one end side in the longitudinal direction of the link member 843 is bent in the pivoting axis direction.

The protrusion 810 is pivotably loosely fit to the slot 863 of the sliding portion 825, thereby forming the first connecting portion. That is to say, the link member 843 is pivotable as to the sliding portion 825 with the first connecting portion as the center of pivoting. The protrusion 810 is capable of moving in the slot 863 in the front-and-rear direction within the range of the slot 863 in the front-and-rear direction (within the opening). A coil spring 860 is disposed between the rear-side edge of the slot 863 and the protrusion 810.

The link member 844 has the connecting shaft portion 530 and the protrusion 848. The connecting shaft portion 530 is provided to one end side in the longitudinal direction of the link member 844. The connecting shaft portion 530 is a cylindrical protrusion erected from the link member 844 to the right side in FIG. 15B. The connecting shaft portion 530 is pivotably inserted into a hole formed in the third support portion 526, thereby forming the third connecting portion. Now, the connecting shaft portion 530 may be formed on the third support portion 526 rather than the link member 844. That is to say, the connecting shaft portion 530 formed on the third support portion 526 may be inserted into a hole formed in the link member 844.

The protrusion 848 is a cylindrical protrusion provided to the other end side in the longitudinal direction of the link member 844, erected to the right side in the pivoting axis direction of the link member 844. A circular hole that extends in the left-and-right direction in FIG. 15B is formed between the protrusion 848 of the link member 844 and the third connecting portion. The connecting shaft portion 538 of the link member 843 is pivotably inserted into this hole, whereby the connecting shaft portion 538 and the hole of the link member 844 make up the fourth connecting portion. That is to say, the link member 844 is capable of pivoting as to the third support portion 526 with the third connecting portion as a center of pivoting, and is capable of pivoting as to the link member 843 with the fourth connecting portion as a center of pivoting. Now, the connecting shaft portion 538 may be formed on the link member 844 rather than the link member 843. That is to say, the connecting shaft portion 538 formed on the link member 844 may be inserted into a hole formed in the link member 843. Note that one of the link member 843 and link member 844 may be omitted from the embodiment regarding the movement mechanism 840.

The holding member 805 has the lens array 506, a link attaching portion 851, a link attaching portion 852, and a pin attaching portion 855. The link attaching portion 851 and link attaching portion 852 both are provided between pins 514 attached to the lens array 506 and holding member 805. Although omitted from illustration, a link attaching portion 853 and link attaching portion 854 to which the link member 845 and link member 846 making up the second link mechanism 859 are attached are both provided between pins 515 attached to the other end side of the lens array 506 and holding member 805. The link attaching portion 851 is a hole formed to the holding member 805 between the lens array 506 and pin attaching portion 855, passing through in the left-and-right direction. The link attaching portion 852 is a slot that is formed in the holding member 805 between the lens array 506 and the link attaching portion 851, and that passes through in the left-and-right direction and extends in the front-and-rear direction.

The protrusion 847 of the link member 843 is pivotably attached to the link attaching portion 851, and the protrusion 848 of the link member 844 is pivotably attached to the link attaching portion 852. The protrusion 848 is attached to the link attaching portion 851 so as to be capable of moving in the front-and-rear direction. Accordingly, the link member 844 is capable of moving by sliding in the front-and-rear direction within the range of the link attaching portion 852 in the front-and-rear direction, while pivoting with the protrusion 848 as a center of pivoting.

According to the above-described configuration, when the sliding portion 825 moves by sliding from the front side to the rear side as to the third support portion 526, the protrusion 810 moves by sliding from the front side to the rear slide as to the third support portion 526 along with the sliding portion 825. Accordingly, when viewing the first link mechanism 858 from the right side as illustrated in FIG. 15A1, the protrusion 848 moves from the front side to the rear side at the link attaching portion 852 with the link member 843 pivoting clockwise with the protrusion 810 as the center of pivoting and the link member 844 pivoting counter-clockwise with the connecting shaft portion 530 as the center of pivoting. Accordingly, the protrusion 847 and protrusion 848 move in the direction from the exposure position toward the retracted position.

On the other hand, when the sliding portion 825 moves by sliding from the rear side to the front side as to the third support portion 526, the protrusion 810 moves by sliding from the rear side to the front slide as to the third support portion 526 along with the sliding portion 825. Accordingly, when viewing the first link mechanism 858 from the right side as illustrated in FIG. 15A2, the protrusion 848 moves from the rear side to the front side at the link attaching portion 852 with the link member 843 pivoting counter-clockwise with the protrusion 810 as the center of pivoting and the link member 844 pivoting clockwise with the connecting shaft portion 530 as the center of pivoting. Accordingly, the protrusion 847 and protrusion 848 move from the retracted position toward the exposure position. When the sliding portion 825 further moves by sliding to the front side in a state where the abutting pin 514 is in contact with an abutting face 550, as illustrated in FIG. 15B, the coil spring 860 is compressed between the rear side edge of the slot 863 and the protrusion 810. The protrusion 810 is biased to the front side by the restoring force of the compressed coil spring 860. Accordingly, biasing force heading upwards is applied to the holding member 805.

A configuration may be made where the front-and-rear directions of the first link mechanism 858 and second link mechanism 859 are opposite, so that when the sliding portion 825 is moved by sliding from the front side toward the rear side, the optical print head 105 moves from the retracted position toward the exposure position, and when the sliding portion 825 is moved by sliding from the rear side toward the front side, the optical print head 105 moves from the exposure position toward the retracted position. In this case, the later-described cover 558 presses the sliding portion 825 from the front side toward the rear side when moving from an opened state to a closed state, and pulls the sliding portion 825 from the rear side toward the front side when moving from a closed state to an opened state.

The mechanism for moving the optical print head 105 is not restricted to the movement mechanism 140, movement mechanism 640, and movement mechanism 840. A movement mechanism 940 illustrated in FIGS. 16A and 16B may be used. The movement mechanism 940 will be described below with reference to FIGS. 16A and 16B. Note that members having substantially the same functions as members making up the movement mechanism 140 (including 640 and 840) are denoted by the same reference numerals, and redundant description may be omitted.

Figure 16A:
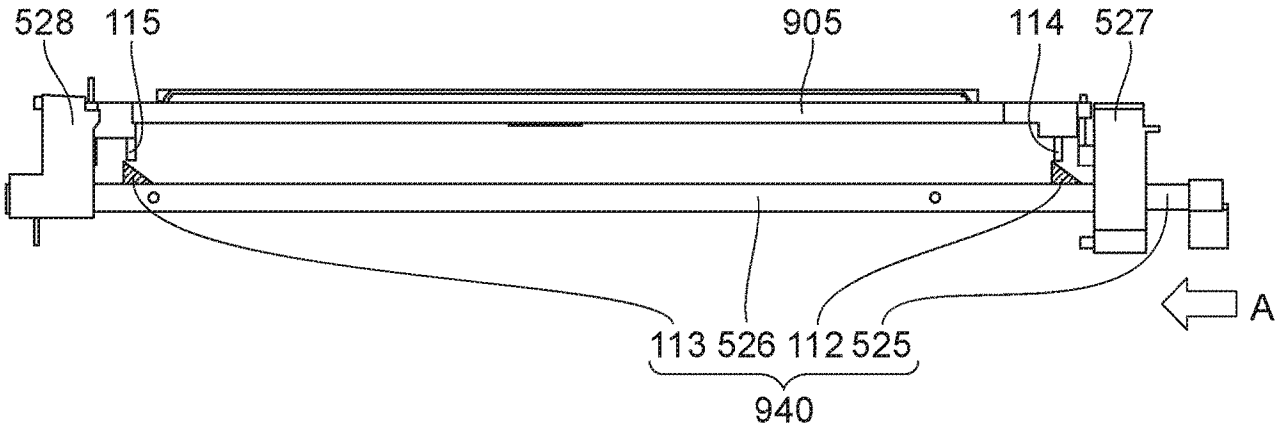
FIGS. 16A and 16B are diagrams describing a movement mechanism using a cam mechanism.
Figure 16B:
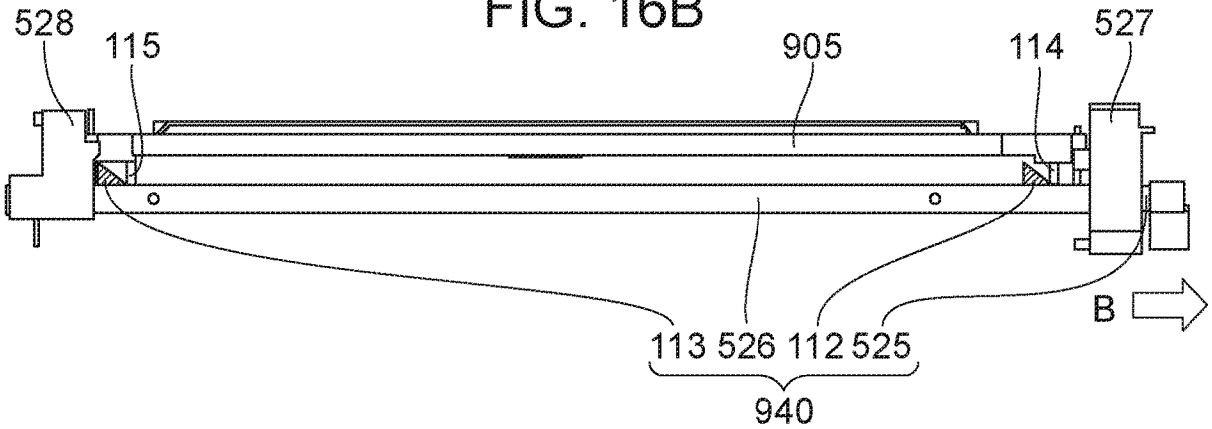

As illustrated in FIGS. 16A and 16B, a first cam portion 112 and a second cam portion 113 are provided to the front side and rear side of the sliding portion 525. A movement support portion 114 and a movement support portion 115 are provided to the front side and rear side at the lower side of the holding member 905. The first cam portion 112 and second cam portion 113 have a face inclined downwards from the rear side toward the front side as to the holding member 905 side.

FIG. 16A is a schematic diagram illustrating the optical print head 105 situated at the exposure position and the movement mechanism 940, as viewed from the right side. When the sliding portion 525 moves by sliding from the front side to the rear side as to the third support portion 526 in a case where the optical print head 105 is at the exposure position, the first cam portion 112 and second cam portion 113 provided to the sliding portion 525 move by sliding from the front side to the rear side as to the third support portion 526, along with the sliding portion 525. Accordingly, the lower ends of the movement support portion 114 and movement support portion 115 provided to the holding member 905 abut the first cam portion 112 and second cam portion 113, and the movement support portion 114 and movement support portion 115 move along the first cam portion 112 and second cam portion 113 in a direction from the exposure position toward the retracted position.

FIG. 16B is a schematic diagram illustrating the optical print head 105 situated at the retracted position and the movement mechanism 940, as viewed from the right side. When the sliding portion 525 moves by sliding from the rear side to the front side as to the third support portion 526 in a case where the optical print head 105 is at the retracted position, the first cam portion 112 and second cam portion 113 provided to the sliding portion 525 move by sliding from the rear side to the front side as to the third support portion 526, along with the sliding portion 525. Accordingly, the lower ends of the movement support portion 114 and movement support portion 115 provided to the holding member 905 are pressed upwards and move along the first cam portion 112 and second cam portion 113 in a direction from the retracted position toward the exposure position.

Now an arrangement may be made where the direction of inclination of the inclined faces that the first cam portion 112 and second cam portion 113 have is inclined downwards from the front side toward the rear side, with sliding movement of the sliding portion 525 from the front side to the rear side moving the optical print head 105 from the retracted position toward the exposure position, and sliding movement of the sliding portion 525 from the rear side to the front side moving the optical print head 105 from the exposure position toward the retracted position. In this case, the later-described cover 558 presses the sliding portion 525 from the front side toward the rear side when moving from an opened state to a closed state, and pulls the sliding portion 525 from the rear side toward the front side when moving from a closed state to an opened state.

Next, the cover 558 will be described with reference to FIGS. 17A through 17C. The cover 558 is a member for causing the sliding portion 525 to move by sliding as described above. Note that the configuration causing the sliding portion 525 to move by sliding is not restricted to the cover 558. For example, a configuration may be made where the sliding portion 525 moves by sliding in conjunction with opening/closing of an unshown front door. Alternatively, a configuration may be made where the sliding portion 525 moves by sliding in conjunction with turning of a turning member such as a lever or the like, rather than a covering member such as the cover 558 or a door.

Figure 17A:
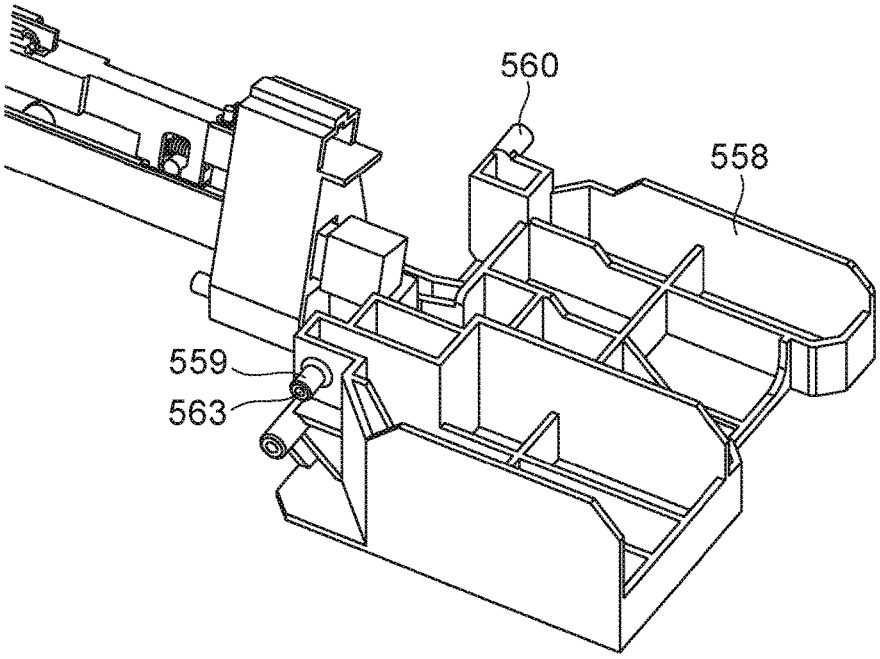
FIGS. 17A through 17C are perspective views of a cover.

FIG. 17A is a perspective view of the cover 558. The cover 558 has a pivoting shaft portion 559 and a pivoting shaft portion 560, as illustrated in FIG. 17A. The pivoting shaft portion 559 is a cylindrical protrusion protruding in the right-side direction of the cover 558, while the pivoting shaft portion 560 is a cylindrical protrusion protruding in the left-side direction of the cover 558.

Figure 17B:
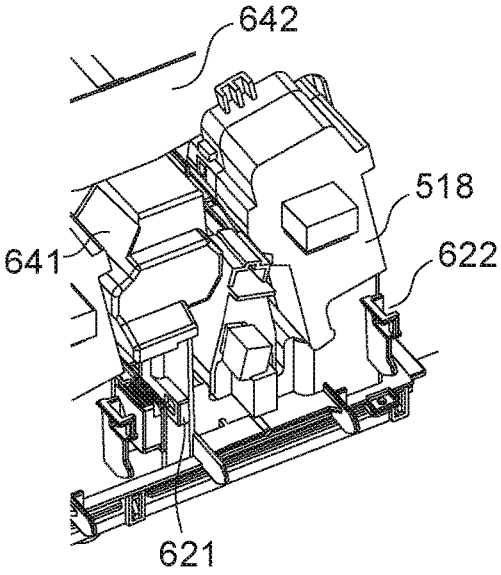
Figure 17C:
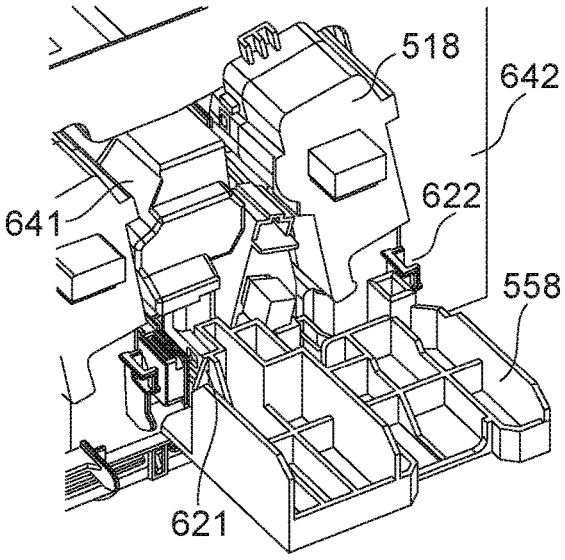

FIG. 17B is an enlarged view of the portion where the cover 558 is attached to the front-side plate 642. FIG. 17C is a perspective view of the cover 558 that has been attached to the front-side plate 642. The front-side plate 642 has a bearing member 621 to which the pivoting shaft portion 559 of the cover 558 fits, and a bearing member 622 to which the pivoting shaft portion 560 fits, as illustrated in FIG. 17B. The pivoting shaft portion 559 of the cover 558 pivotably fits to the bearing member 621 of the front-side plate 642, and the pivoting shaft portion 560 pivotably fits to the bearing member 622 of the front-side plate 642, as illustrated in FIG. 17C. The pivoting axis of the pivoting shaft portion 559 and the pivoting axis of the pivoting shaft portion 560 are on the same axis (pivoting axis 563), as illustrated in FIG. 17A. The pivoting axis 563 is positioned to the lower side from the rotational axis of the photosensitive drum 103 in the vertical direction. The cover 558 pivots as to the main body of the image forming apparatus centered on the pivoting axis 563, and is capable of being closed and opened. The cover 558 moves between a closed state (closed position) to close off the path of travel for replacing the drum unit 518 and developing unit 641, and an opened state (opened position) to secure the path of travel. Accordingly, when the cover 558 is in a closed state, replacement of the drum unit 518 and developing unit 641 cannot be performed by the worker. The worker can replace the drum unit 518 by opening the cover 558, and closes the cover 558 when the work is completed.

Figure 18A:
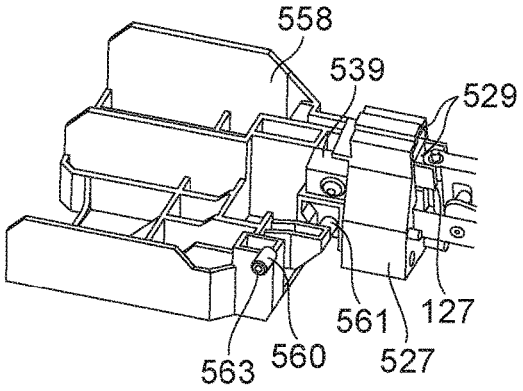
FIGS. 18A through 18D are perspective views of a cover, for description of operations when the cover is closed.
Figure 18B:
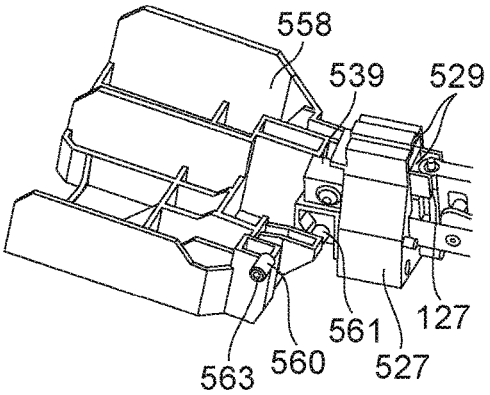

Next, the configuration by which the sliding portion 525 moves by sliding in the pivoting axis direction of the photosensitive drum 103 in conjunction with opening/closing operations of the cover 558 (pivoting member) will be described with reference to FIGS. 18A through 21D. FIGS. 18A through 18D are perspective diagrams illustrating the cover 558 pivoting from an opened state toward a closed state. FIGS. 19A through 19D are cross-sectional views illustrating the cover 558 pivoting from the opened state toward the closed state. FIGS. 18A and 19A illustrate the opened state of the cover 558. FIGS. 18D and 19D illustrate the closed state of the cover 558. FIGS. 18B and 19B, and FIGS. 18C and 19C, are diagrams illustrating the cover 558 transitioning from the opened state to the closed state. Note that the closed state of the cover 558 in the closed state illustrated in FIGS. 18D and 19D is maintained by a snap fit mechanism for engaging to the main body, a stopper for preventing pivoting, or the like.

The cover 558 pivots as to the main body of the image forming apparatus 1 centered on the pivoting axis 563, as illustrated in FIGS. 18A through 18D. The cover 558 has the pressing member 561 (pressing portion) that moves around the pivoting axis 563, at the lower side from the pivoting axis 563. The pressing member 561 is a cylindrical protrusion for example, protruding from the left side toward the right side of the cover 558, and is situated at the accommodation space 562 provided to one end of the sliding portion 525. The pressing member 561 moves over part of a circle (movement path 564) centered on the pivoting axis 563 in accordance with pivoting of the cover 558, as illustrated in FIGS. 19A through 19D. When the cover 558 is in an opened state, the pressing member 561 is situated further toward the rear side than the pivoting axis 563, and when the cover 558 is in a closed state, the pressing member 561 is situated further toward the front side than the pivoting axis 563. The position of the pressing member 561 when the cover 558 is in the closed state is closer to the photosensitive drum 103 side than the position of the pressing member 561 when the cover 558 is in the opened state.

Figure 19A:
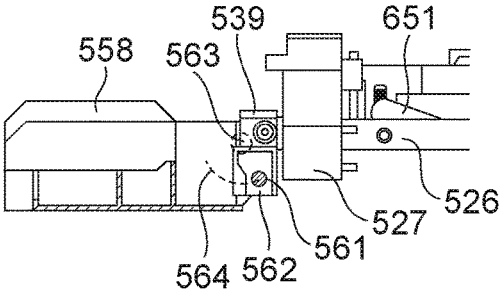
FIGS. 19A through 19D are perspective views of a cover, for description of operations when the cover is closed.
Figure 19B:
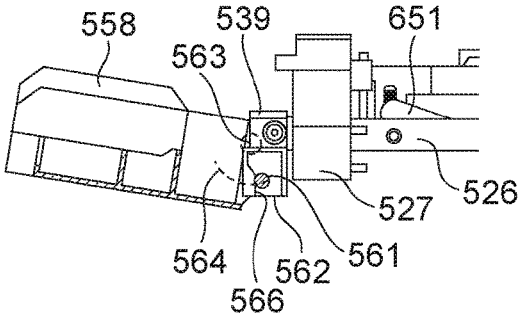
Figure 19C:
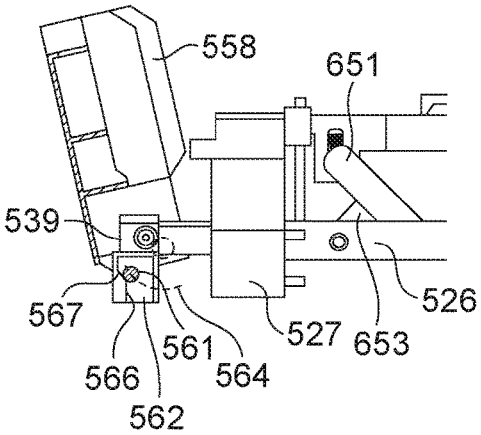

The slide aiding member 539 is attached to one end side of the sliding portion 525, as illustrated in FIGS. 19A through 19D. The accommodation space 562 where the later-described pressing member 561 is accommodated is formed in the slide aiding member 539. The slide aiding member 539 also includes a first pressed portion 566, second pressed portion 567, and third pressed portion 569. In a case where the optical print head 105 is in the retracted position, the first pressed portion 566 is situated on the movement path 564, and the second pressed portion 567 is provided adjacent to the first pressed portion 566 to the downstream side (front side) of the first pressed portion 566 in the direction following the movement path 564, as illustrated in FIG. 19A. The third pressed portion 569 is situated to the upper side of the second pressed portion 567 at the downstream side (front side). The shape of the second pressed portion 567 is a shape that matches part of a circle centered on the pivoting axis 563 in a case where the pressing member 561 is on the second pressed portion 567, as illustrated in FIG. 19C. At this time, the curvature of the circle of which the radius is the distance from the pivoting axis 563 to the second pressed portion 567 with the pivoting axis 563 as the center thereof is equal to the curvature of the movement path 564. Note that the second pressed portion 567 does not need to be a shape strictly following the movement path 564. For example, a shape generally following a tangential line of which the point of tangent is a point on the movement path 564 that is closest to the boundary point between the first pressed portion 566 and second pressed portion 567 (an inclined face inclining to the photosensitive drum 103 side from the rear side toward the front side) will suffice. From a state where the pressing member 561 abuts the first pressed portion 566, the pressing member 561 sequentially moves from above the first pressed portion 566, to above the second pressed portion 567, and above a fourth pressed portion 568, in conjunction with the cover 558 having moved from the opened state toward the closed state.

Operations of the pressing member 561 as to the sliding portion 525 will be described with reference to FIGS. 19A through 19D. When the cover 558 is in the state in FIG. 19A (opened state), the optical print head 105 is situated at the retracted position, and the pressing member 561 is situated at the other end side as compared to the first pressed portion 566 and second pressed portion 567. When the cover 558 pivots in the clockwise direction from the state in FIG. 19A, the pressing member 561 abuts the first pressed portion 566 situated on the movement path 564 (FIG. 19B). Upon the cover 558 further pivoting in the clockwise direction from this state, the pressing member 561 presses the first pressed portion 566 to the front side. Accordingly, the slide aiding member 539 moves to the front side. The slide aiding member 539 is fixed to the sliding portion 525, so the sliding portion 525 also moves by sliding to the front side along with the movement of the slide aiding member 539. Ideally, the first pressed portion 566 is perpendicular to the rotational axis of the photosensitive drum 103 at this time, in order to maximize the amount of movement of the sliding portion 525 as to the amount of pivoting of the cover 558. However, this does not need to be strictly perpendicular, and may be inclined toward the front side by around 0 to 10° from the perpendicular direction, for example.

When the cover 558 further pivots in the clockwise direction, the pressing member 561 moves from above the first pressed portion 566 to above the second pressed portion 567 (FIG. 19C). The second pressed portion 567 has a shape following the movement path 564 of the pressing member 561, so in a case of the cover 558 further pivoting in the clockwise direction from the state in FIG. 19C, the pressing member 561 moves upwards in contact with the second pressed portion 567, but the pressing member 561 does not impart force to the slide aiding member 539 to further move the slide aiding member 539 toward the front side by sliding. That is to say, the sliding portion 525 maintains a stopped state, without moving in conjunction with the pivoting of the cover 558. When the cover 558 is in the state in FIG. 19C (closed state), the optical print head 105 is situated at the exposure position, and the pressing member 561 is situated further toward the side of the rotational axis of the photosensitive drum 103 as compared to the first pressed portion 566, and is further toward the one end side as compared to the first pressed portion 566.

Figure 18C:
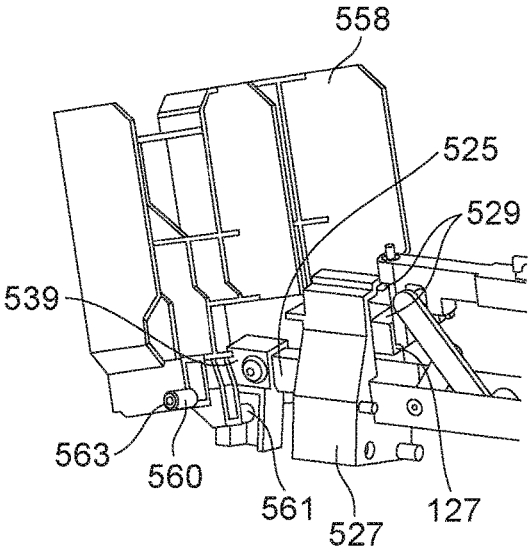
Figure 18D:
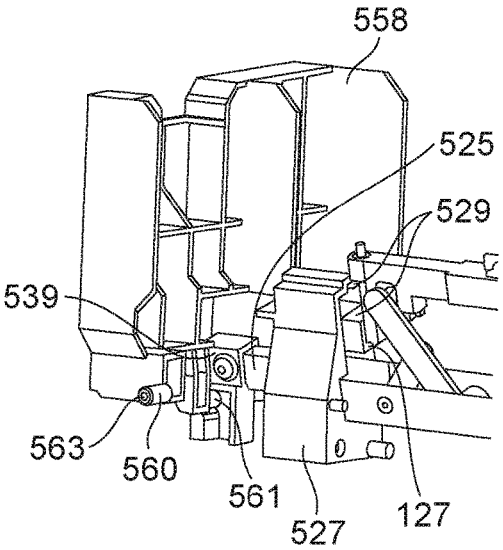
Figure 19D:
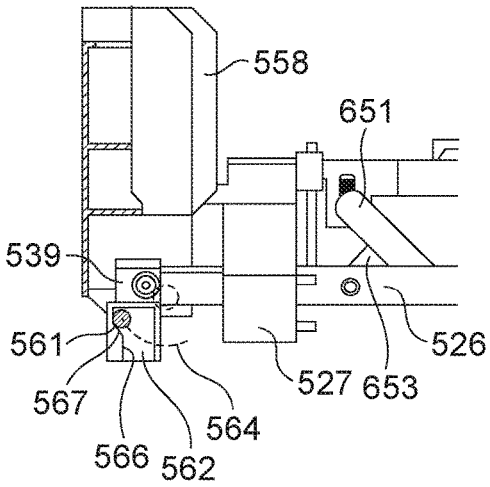

It can be seen from FIGS. 18C and 19C that when the cover 558 pivots from the opened state toward the closed state, the pressing member 561 abuts the second pressed portion 567 of the accommodation space 562 immediately after the holding member 505 has reached the exposure position. In a case of further pivoting the cover 558 from the state in FIG. 19C in the clockwise direction, the pressing member 561 moves sliding over the second pressed portion 567 that it abuts. In a state where the pressing member 561 abuts the second pressed portion 567, the distance between the movement path 564 and the second pressed portion 567 is equal regardless of the position of the pressing member 561. Accordingly, even if the cover 558 pivots, force to move the slide aiding member 539 by sliding further toward the front side is not imparted from the pressing member 561 to the second pressed portion 567. Accordingly, the slide aiding member 539 does not move from the rear side toward the front side while the pressing member 561 is moving over the second pressed portion 567. Also, the sliding portion 525 tries to move from the front side toward the rear side by sliding, due to the deadweight of the holding member 505 and so forth, but the pressing member 561 has abutted the second pressed portion 567 from the rear side toward the front side, so the sliding portion 525 cannot move from the front side toward the rear side. That is to say, the movement mechanism 640 according to the present embodiment is configured such that when the cover 558 pivots in a state where the pressing member 561 is abutting the first pressed portion 566, the sliding portion 525 moves by sliding in conjunction with the movement of the pressing member 561, but the sliding portion 525 does not move by sliding even if the cover 558 pivots in a state where the pressing member 561 is abutting the second pressed portion 567. By further pivoting the cover 558 from the state in FIG. 19C in the clockwise direction, the pressing member 561 moves to above the third pressed portion 569, and the cover 558 reaches the closed state illustrated in FIG. 19D.

According to this arrangement, the amount of movement of the sliding portion 525 in the front-and-rear direction as to the amount of movement of the pressing member 561 in the front-and-rear direction in a case where the pressing member 561 is in contact with (or abutting) the second pressed portion 567 can be made to be smaller than the amount of movement of the sliding portion 525 in the front-and-rear direction as to the amount of movement of the pressing member 561 in the front-and-rear direction in a case where the pressing member 561 is pressing the first pressed portion 566. That is to say, the amount of movement of the protrusion 655 in the vertical direction as to the amount of movement of the pressing member 561 in the front-and-rear direction in a case where the pressing member 561 is in contact with (or abutting) the second pressed portion 567 can be made to be smaller than the amount of movement of the protrusion 655 as to the amount of movement of the pressing member 561 in the front-and-rear direction in a case where the pressing member 561 is pressing the first pressed portion 566.

Figure 20A:
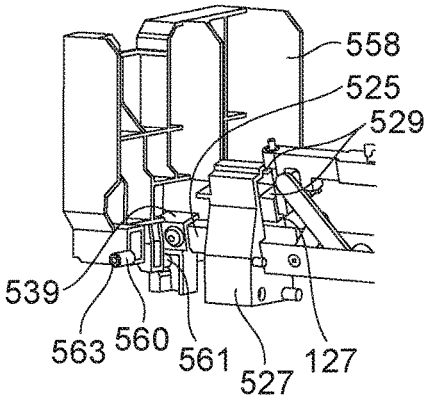
FIGS. 20A through 20D are perspective views of a cover, for description of operations when the cover is opened.
Figure 20B:
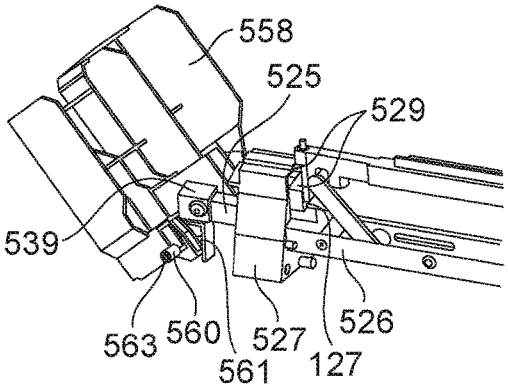
Figure 20C:
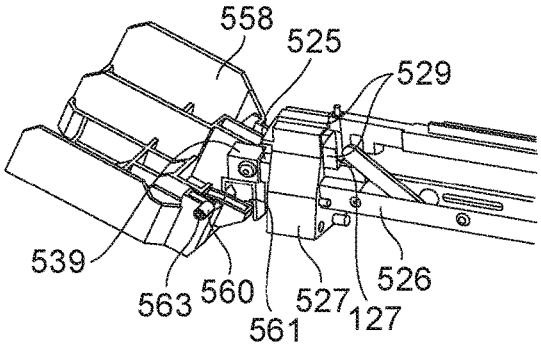
Figure 20D:
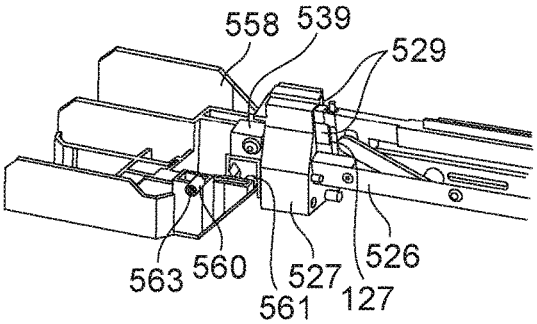
Figure 21A:
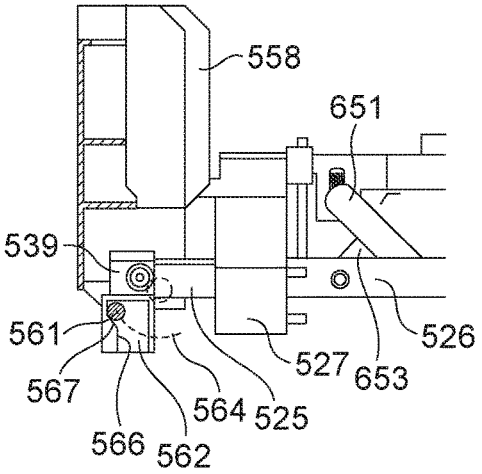
FIGS. 21A through 21D are side views of a cover, for description of operations when the cover is opened.

FIGS. 20A through 20D are perspective diagrams illustrating the cover 558 pivoting from the closed state toward the opened state. FIGS. 21A through 21D are cross-sectional views illustrating the cover 558 pivoting from the closed state toward the opened state. FIGS. 20A and 21A illustrate the closed state of the cover 558. FIGS. 20D and 21D illustrate the opened state of the cover 558. FIGS. 20B and 21B, and FIGS. 20C and 21C, are diagrams illustrating the cover 558 transitioning from the closed state to the opened state.

In the closed state of the cover 558 illustrated in FIG. 21A, force is placed on the sliding portion 525 via the first link mechanism 861 and second link mechanism 862 to slide from the front side toward the rear side, by the deadweight of the optical print head 105 and the restoring force of later-described springs. However, the cover 558 in the closed state is fixed to the main body of the image forming apparatus 1 so that the cover 558 does not pivot, and the pressing member 561 restricts movement of the slide aiding member 539 to the rear side, so the sliding portion 525 does not move by sliding to the rear side.

The slide aiding member 539 has the fourth pressed portion 568, as illustrated in FIGS. 21A through 21D. The fourth pressed portion 568 is provided to the rear side from the pressing member 561 on the movement path 564, and faces the first pressed portion 566. Although the fourth pressed portion 568 is perpendicular to the rotational axis of the photosensitive drum 103 in the present embodiment, this does not need to be strictly perpendicular, and may be inclined toward the front side by around 0 to 10° from the perpendicular direction, for example.

Figure 21B:
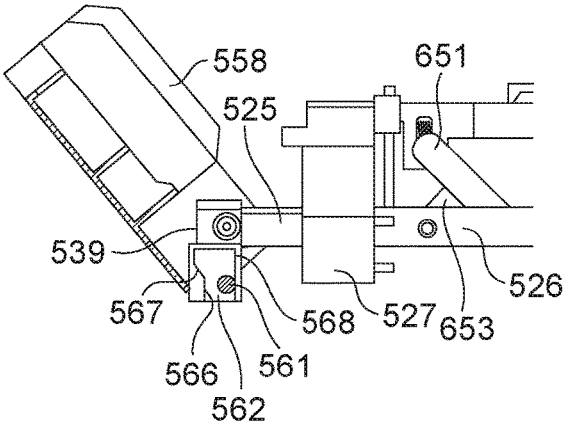
Figure 21C:
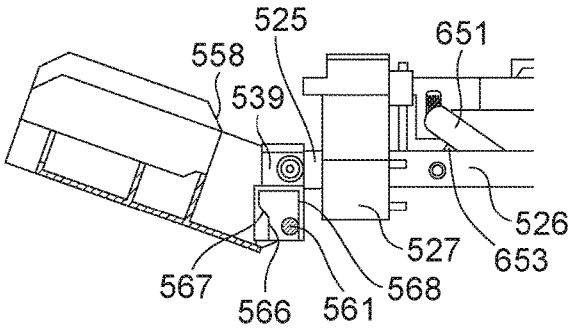
Figure 21D:
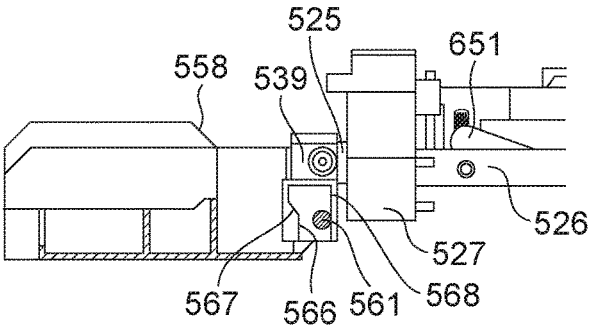

When the cover 558 pivots in the counter-clockwise direction from the state in FIG. 21A, the pressing member 561 abuts the fourth pressed portion 568, as illustrated in FIG. 21B. Upon the cover 558 further pivoting in the counter-clockwise direction from the state in FIG. 21B, the pressing member 561 presses the fourth pressed portion 568 from the front side toward the rear side as illustrated in FIGS. 21B and 21C, and the sliding portion 525 moves toward the rear side. Thereafter, further pivoting of the cover 558 in the counter-clockwise direction brings the cover 558 to the opened state as illustrated in FIG. 21D.

The mechanism where the pressing member 561 presses the fourth pressed portion 568 is provided from the following reason. That is to say, a case can be conceived where the sliding portion 525 does not move to the rear side even if restriction on movement of the slide aiding member 539 by the pressing member 561 is released by the cover 558 being pivoted in the counter-clockwise direction from the state in FIG. 20A, if frictional force among the link members, frictional force between the link member 651 or link member 653 and the sliding portion 525, and frictional force between the link member 652 or link member 654 and the third support portion 526, are great. That is to say, a case can be conceived where the sliding portion 525 does not move by sliding even though the cover 558 has been opened. In order to deal with this, the movement mechanism according to the present embodiment includes the mechanism where the pressing member 561 presses the fourth pressed portion 568, so that opening the cover 558 causes the sliding portion 525 to move toward the rear side. According to the configuration described above, a worker performing maintenance opening and closing the cover 558 causes the sliding portion 525 to move by sliding with regard to the third support portion 526, in conjunction with movement of the cover 558.

Note that a member for moving the sliding portion 525 by sliding is not restricted to the cover 558, and a lever may be used. In this case, this lever may be integrally structured with a cover pivotably attached to the main body of the image forming apparatus 1, so that the level moves in conjunction with a worker who performs maintenance opening/closing the cover. Also, although the first pressed portion 566, second pressed portion 567, and fourth pressed portion 568 in the present embodiment are faces which the pressing member 561 comes into contact with, the structures thereof are not restricted to planar forms, and may be linear forms.

Figure 22A:
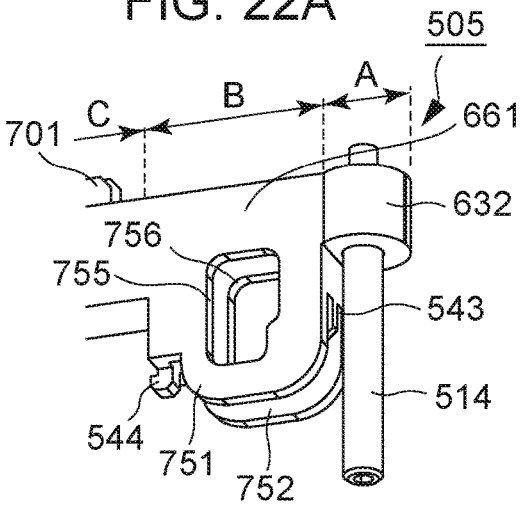
FIGS. 22A through 22D are perspective views for describing the structure of both ends of a holding member.
Figure 22B:
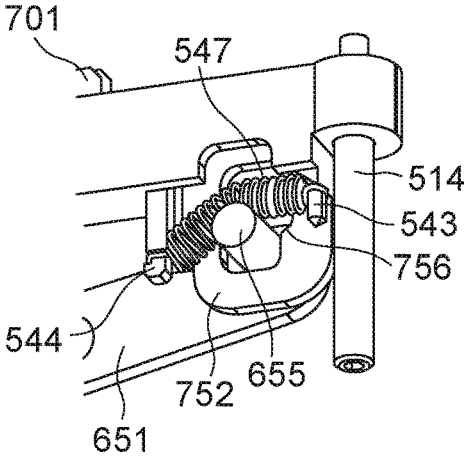
Figure 22C:
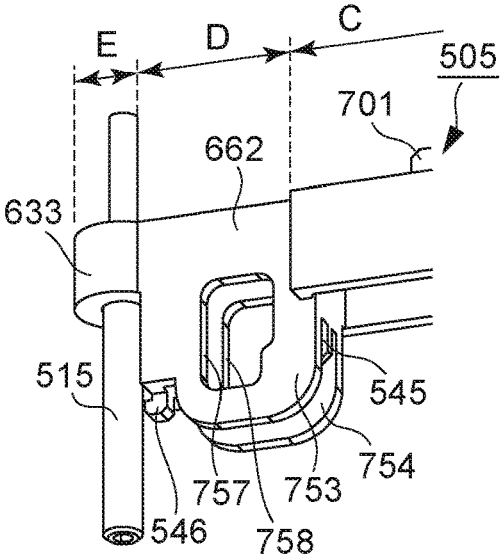
Figure 22D:
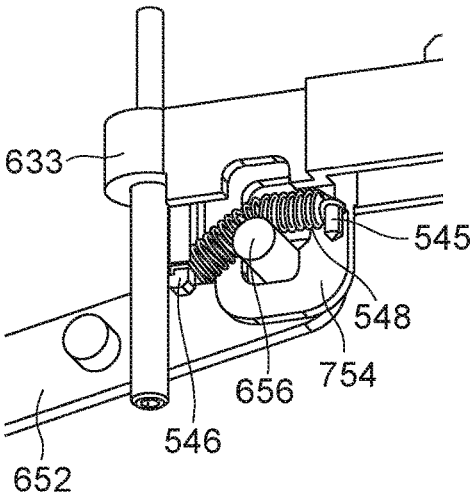

Next, a connection mechanism between the holding member 505 and the link member 651 will be described. FIGS. 22A and 22C are perspective views illustrating the one end side of the holding member 505 in the front-and-rear direction. FIGS. 22B and 22D are perspective views illustrating the other end side of the holding member 505 in the front-and-rear direction.

The holding member 505 is provided with the lens attaching portion 701 to which the lens array 506 is attached, the spring attaching portion 661 to which a coil spring 547 is attached, the spring attaching portion 662 to which a coil spring 548 is attached, the pin attaching portion 632 to which the abutting pin 514 is attached, and the pin attaching portion 633 to which the abutting pin 515 is attached, as illustrated in FIG. 22A. The holding member 505 is a resin molded article where the lens attaching portion 701, circuit board attaching portion 702 (omitted from illustration), spring attaching portion 661, and spring attaching portion 662, have been integrally molded by injection molding. The spring attaching portion 661 is disposed to the one end side of the lens attaching portion 701 in the front-and-rear direction, and the pin attaching portion 632 is disposed further to the end portion side of the spring attaching portion 661 in the holding member 505. The spring attaching portion 662 is disposed to the end portion side of the lens attaching portion 701 in the front-and-rear direction, and the pin attaching portion 632 is disposed further to the other end side of the spring attaching portion 662 in the holding member 505. The places where the lens attaching portion 701, spring attaching portion 661, and pin attaching portion 632 are formed in the holding member 505 are region C, region B, and region A in FIG. 22A. The holding member 505 is subjected to upwards biasing force from below, by the protrusion 655 of the link member 651 via the coil spring 547, at a position to the front side of the lens array 506 but to the rear side of the abutting pin 514. Also, the places where the lens attaching portion 701, spring attaching portion 662, and pin attaching portion 633 are formed in the holding member 505 are region C, region D, and region E in FIG. 22C. Biasing force is applied to the holding member 505 from the lower side toward the upper side by the protrusion 156 of the link member 652 via the coil spring 548, at a position to the rear side from the lens array 506 but to the front side from the abutting pin 515.

First, description will be made regarding the spring attaching portion 661. The spring attaching portion 661 includes a first wall portion 751, a second wall portion 752, a first engaging portion 543, and a second engaging portion 544. The first wall portion 751 is disposed to the one side of the holding member 505 in the left-and-right direction, and the second wall portion 752 is disposed to the other side of the holding member 505 in the left-and-right direction. The first wall portion 751 and second wall portion 752 are disposed to both sides of the abutting pin 514 in the left-and-right direction, in the present embodiment. The first wall portion 751 and second wall portion 752 each have an inner wall face facing each other, as illustrated in FIG. 22A. An opening 755 is formed in the first wall portion 751, and an opening 756 is formed in the second wall portion 752. The opening 755 and the opening 756 are slots extending in the vertical direction. The protrusion 655 is inserted to the opening 755 and opening 756. The protrusion 655 is not fit to the opening 755 and opening 756, and is inserted with a gap of around 0.5 mm even at the narrowest place in the front-and-rear direction. Accordingly, the direction of movement of the protrusion 655 is guided in the vertical direction by the opening 755 and opening 756, without any great frictional force being applied by the inner wall faces of the opening 755 and opening 756.

FIG. 22B is a diagram where the first wall portion 751 has been omitted from illustration in FIG. 22A. The first engaging portion 543 and second engaging portion 544 are disposed between the first wall portion 751 and second wall portion 752 in the left-and-right direction. This first engaging portion 543 and second engaging portion 544 also are respectively disposed on the front side and rear side of the opening 755 and opening 756 in the front-and-rear direction. The first engaging portion 543 is disposed further toward the end portion side of the holding member 505 than the second engaging portion 544 in the present embodiment. The first engaging portion 543 and second engaging portion 544 are protrusions that protrude downwards from connecting portions connecting the first wall portion 751 and second wall portion 752 of the holding member 505. One end of the coil spring 547 is engaged with the first engaging portion 543, and the other end of the coil spring 547 is engaged with the second engaging portion 544. The first engaging portion 543 and second engaging portion 544 are disposed at the spring attaching portion 661 such that the coil spring 547 that is engaged at the first engaging portion 543 and second engaging portion 544 traverses the opening 755 and opening 756.

The first engaging portion 543 and second engaging portion 544 are disposed at positions that are different from each other in the vertical direction. The first engaging portion 543 is disposed closer to the photosensitive drum 103 side than the second engaging portion 544 in the present embodiment. Note that an arrangement may be made where the first engaging portion 543 and second engaging portion 544 are provided at positions to be generally the same height, and the second engaging portion 544 may be disposed closer to the photosensitive drum 103 side than the first engaging portion 543.

The protrusion 655 is inserted to the opening 756 of the second wall portion 752 from the outer wall face side thereof, passes beneath the coil spring 547 strung between the first engaging portion 543 and second engaging portion 544, and is inserted into the opening 755 of the first wall portion 751, as illustrated in FIG. 22B.

Next, description will be made regarding the spring attaching portion 662. The spring attaching portion 662 includes a third wall portion 753, a fourth wall portion 754, a third engaging portion 545, and a fourth engaging portion 546, as illustrated in FIG. 22C. The third wall portion 753 is disposed to the one side of the holding member 505 in the left-and-right direction, and the fourth wall portion 754 is disposed to the other side of the holding member 505 in the left-and-right direction. The third wall portion 753 and fourth wall portion 754 are disposed to both sides of the abutting pin 515 in the left-and-right direction, in the present embodiment. The first wall portion 751 and the third wall portion 753 are disposed on the same side in the left-and-right direction, i.e., the first wall portion 751 and the third wall portion 753 are disposed on the right side of the holding member 505 in the left-and-right direction. The second wall portion 752 and the fourth wall portion 754 are disposed on the same side in the left- and right direction, i.e., the second wall portion 752 and the fourth wall portion 754 are disposed on the left side of the holding member 505 in the left-and-right direction.

The third wall portion 753 and fourth wall portion 754 each have an inner wall face facing each other, as illustrated in FIG. 22C. An opening 757 is formed in the third wall portion 753, and an opening 758 is formed in the fourth wall portion 754. The opening 757 and the opening 758 are slots extending in the vertical direction. The protrusion 656 is inserted to the opening 757 and opening 758. The protrusion 656 is not fit to the opening 757 and opening 758, and is inserted with a gap of around 0.5 mm even at the narrowest place in the front-and-rear direction. Accordingly, the direction of movement of the protrusion 656 is guided in the vertical direction by the opening 757 and opening 758, without any great frictional force being applied by the inner wall faces of the opening 757 and opening 758.

FIG. 22D is a diagram where the third wall portion 753 has been omitted from illustration in FIG. 22C. The third engaging portion 545 and fourth engaging portion 546 are disposed between the third wall portion 753 and fourth wall portion 754 in the left-and-right direction. This third engaging portion 545 and fourth engaging portion 546 also are respectively disposed on the front side and rear side of the opening 757 and opening 758 in the front-and-rear direction. The fourth engaging portion 546 is disposed further toward the end portion side of the holding member 505 than the third engaging portion 545 in the present embodiment. The third engaging portion 545 and fourth engaging portion 546 are protrusions that protrude downwards from connecting portions connecting the third wall portion 753 and fourth wall portion 754 of the holding member 505. One end of the coil spring 548 is engaged with the third engaging portion 545, and the other end of the coil spring 548 is engaged with the fourth engaging portion 546. The third engaging portion 545 and fourth engaging portion 546 are disposed at the spring attaching portion 662 such that the coil spring 548 that is engaged at the third engaging portion 545 and fourth engaging portion 546 traverses the opening 757 and opening 758.

The third engaging portion 545 and fourth engaging portion 546 are disposed at positions that are different from each other in the vertical direction. The third engaging portion 545 is disposed closer to the photosensitive drum 103 side than the fourth engaging portion 546 in the present embodiment. Note that an arrangement may be made where the third engaging portion 545 and fourth engaging portion 546 are provided at positions to be generally the same height, and the fourth engaging portion 546 may be disposed closer to the photosensitive drum 103 side than the third engaging portion 545.

The protrusion 656 is inserted to the opening 758 of the fourth wall portion 754 from the outer wall face side thereof, passes beneath the coil spring 548 strung between the third engaging portion 545 and fourth engaging portion 546, and is inserted into the opening 757 of the third wall portion 753, as illustrated in FIG. 22D. Although a coil spring has been described as an example of the coil spring 547 and coil spring 548 in the present embodiment, plate springs may be used instead.

Next, the operations of the protrusion 655 provided to the link member 651 on the coil spring 547, and the operations of the protrusion 656 provided to the link member 652 on the coil spring 548, will be described with reference to FIGS. 23A through 23C. The operations of the protrusion 655 on the coil spring 547 and the operations of the protrusion 656 on the coil spring 548 are the same, so the operations of the protrusion 656 on the coil spring 548 will be exemplified in FIGS. 23A through 23C.

Figure 23A:
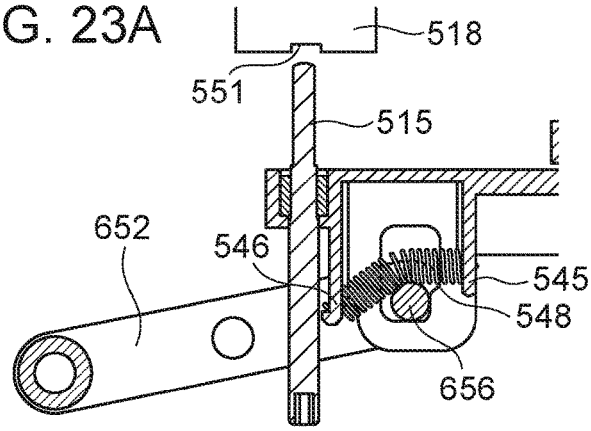
FIGS. 23A through 23C are perspective views for describing the structure of the other end of the holding member.

FIG. 23A is a diagram illustrating a state where the abutting pin 515 provided to the holding member 505 is retracted from the abutting face 551 of the drum unit 518. FIG. 23B is a diagram illustrating the point of the abutting pin 515 abutting the abutting face 551 of the drum unit 518. FIG. 23C is a diagram illustrating a state where the link member 652 has pivoted in the counter-clockwise direction from the state in FIG. 23B.

Upon the sliding portion 525 moving by sliding in the state in FIG. 23A, the link member 652 pivots in the counter-clockwise direction in conjunction therewith, and the protrusion 656 moves upwards. At this time, the protrusion 656 presses the coil spring 548 upwards. The protrusion 656 pressing the coil spring 548 upwards causes upward force to be applied to the holding member 505 via the third engaging portion 545 and fourth engaging portion 546. The abutting pin 515 is not in contact with the drum unit 518, and there is no force countering the force of the protrusion 656 pressing the coil spring 548, other than the gravity acting on the optical print head 105. Accordingly, when the upward force acting on the third engaging portion 545 and the fourth engaging portion 546 exceeds the gravity acting on the optical print head 105, the holding member 505 moves upwards by the force acting on the third engaging portion 545 and fourth engaging portion 546. Now, an arrangement may be made where, when the holding member 505 is in the retracted position, the lower end of the abutting pin 515 (514) and the holding member 505 are supported by the apparatus main body, and the protrusion 656 (655) of the link member 652 (651) is not in contact with the coil spring 548 (547).

Figure 23B:
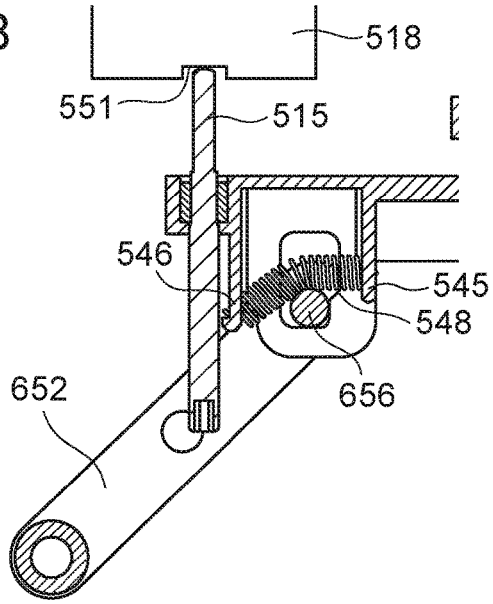

When the holding member 505 moves upwards, the abutting pin 515 abuts the abutting face 551 of the drum unit 518 as illustrated in FIG. 23B. In FIG. 23B, the optical print head 105 is situated at the exposure position, but the biasing force acting on the optical print head 105 to bias the optical print head 105 against the drum unit 518 is insufficient. Accordingly, the movement mechanism 140 according to the present embodiment has a configuration where the link member 652 is capable of further pivoting from the state in FIG. 23B, to apply the above-described biasing force to the optical print head 105.

Further pivoting the link member 652 in the counter-clockwise direction from the state in FIG. 23B does not change the position of the holding member 505, since the abutting pin 515 is already abutting the abutting face 551 of the drum unit 518. On the other hand, the protrusion 656 moves upwards, so the coil spring 548 is pressed by the protrusion 656 passing between the third engaging portion 545 and fourth engaging portion 546, and flexes and stretches as illustrated in FIG. 23C.

Figure 23C:
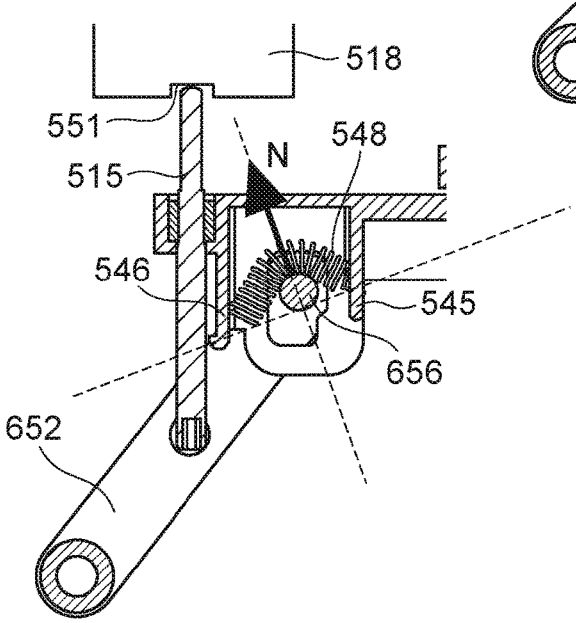

The state in FIG. 23C corresponds to the state of the cover 558 in FIGS. 19C and 19D. That is to say, the sliding portion 525 is in a state where there is no further movement by sliding toward the front side. Accordingly, the link member 652 does not pivot further in the counter-clockwise direction from the state in FIG. 23C, since the sliding portion 525 does not move by sliding, and the protrusion 656 does not move upwards and is stationary at the position in FIG. 23C. The contracting force of the coil spring 548 acts on the third engaging portion 545 and fourth engaging portion 546 in this state. A force component of the contracting force of the coil spring 548 acting on the third engaging portion 545 and fourth engaging portion 546 is directed upwards, so biasing force acts on the holding member 505 to bias the holding member 505 toward the drum unit 518 side, and the holding member 505 is biased against the drum unit 518 via the abutting pin 515.

As described above, the third engaging portion 545 is disposed closer to the photosensitive drum 103 side than the fourth engaging portion 546, so normal force in the direction of the arrow N acts on the coil spring 548 from the protrusion 656. The force component in the direction of the arrow N acts on the holding member 505. Accordingly, force toward the rear side in the front-and-rear direction acts on the abutting pin 515, and the abutting pin 515 abutting the abutting face 551 is biased against and abuts the rear-side wall face 596 at the deepest part of the fitting portion 685. The reason why the first engaging portion 543 is disposed closer to the photosensitive drum 103 side than the second engaging portion 544 is also the same.

As described above, in the image forming apparatus 1 according to the above embodiment, the movement in the left-and-right direction of the holding member 505 moving from the retracted position toward the exposure position is restricted by the first wall face 588 and second wall face 589 formed on the second support portion 528, and the abutting pin 515 is guided so as to abut the fitting portion 685.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-119002 filed Jun. 16, 2017, which is hereby incorporated by reference herein in its entirety.

What is claimed is:

1. An image forming apparatus comprising:

a drum unit including a photosensitive drum and being replaceable by being mounted into and dismounted from a main assembly;

an optical print head configured to expose the photosensitive drum;

a movement mechanism configured to reciprocally move the optical print head between an exposure position where the photosensitive drum is exposed, and a retracted position that is further retracted from the drum unit than the exposure position;

an abutting pin provided integrally with at least one of one end side and the other end side of the optical print head in a longitudinal direction of the optical print head and protrude from the optical print head toward a drum unit side and an opposite side opposite to the drum unit side in a reciprocation direction, in which the optical print head moves reciprocally, and configured to abut an abutting portion formed on the drum unit so as to position the optical print head with respect to the drum unit;

a first restrict portion fixed to the main assembly at an opposite side opposite to a side where the drum unit is provided with respect to the optical print head, and configured to restrict movement of the abutting pin in a perpendicular direction, which is perpendicular to both the longitudinal direction and the reciprocation direction; and a second restrict portion fixed to the main assembly, and configured to restrict movement, in the perpendicular direction, of the optical print head moving from the retracted position to the exposure position, wherein the optical print head moved by the movement mechanism from the retracted position to the exposure position is positioned with respect to the drum unit by abutment of the abutting pin with the abutting portion while the movement of the abutting pin in the perpendicular direction is restricted by the first restrict portion and while the movement of the optical print head in the perpendicular direction is restricted by the second restrict portion.

2. The image forming apparatus according to claim 1, wherein the first restrict portion comprises:

a first facing portion located at one side rather than the abutting pin in the perpendicular direction and facing the abutting pin in the perpendicular direction; and a second facing portion located at the other side rather than the abutting pin in the perpendicular direction and facing the abutting pin in the perpendicular direction;

wherein the abutting pin moved from the retracted position to the exposure position comes into contact with the first facing portion to restrict the movement of the abutting pin moving from the other side to the one side and the abutting pin moved from the retracted position to the exposure position comes into contact with the second facing portion to restrict the movement of the abutting pin moving from the one side to the other side.

3. The image forming apparatus according to claim 2, wherein the second restrict portion comprises:

a third facing portion located at one side rather than the optical print head in the perpendicular direction and facing the optical print head in the perpendicular direction; and a fourth facing portion located at the other side rather than the optical print head in the perpendicular direction and facing the optical print head in the perpendicular direction;

wherein the optical print head moved from the retracted position to the exposure position comes into contact with the third facing portion to restrict the movement of the optical print head moving from the other side to the one side and the optical print head moved from the retracted position to the exposure position comes into contact with the fourth facing portion to restrict the movement of the abutting pin moving from the one side to the other side.

4. The image forming apparatus according to claim 1, wherein the abutting pin is provided on both one end side and the other end side of the optical print head in the longitudinal direction.

5. The image forming apparatus according to claim 1, wherein the first restrict portion and the second restrict portion are integral with each other.

6. The image forming apparatus according to claim 1, wherein the optical print head and the second restrict portion are not in contact with each other when the optical print head is located at the exposure position.

7. The image forming apparatus according to claim 1, wherein a gap is formed in the second restrict portion to which the optical print head fits, so as to restrict movement in the perpendicular direction of the optical print head moving from the retracted position toward the exposure position, and to guide movement of the optical print head in the direction of reciprocal movement, wherein the abutting pin portion is a recess to which the drum unit side end portion of the abutting pin fits, and wherein the difference between the width in the perpendicular direction of the recess and the width in the perpendicular direction of the end portion is smaller than the difference between the width in the perpendicular direction of the gap formed by the second restrict portion and the width in the perpendicular direction of a second restrict portion side of the one end side or the other end side of the optical print head.

8. An image forming apparatus comprising:

a drum unit including a photosensitive drum and being replaceable by being mounted into and dismounted from a main assembly;

an optical print head configured to expose the photosensitive drum;

a movement mechanism configured to reciprocally move the optical print head between an exposure position where the photosensitive drum is exposed, and a retracted position that is further retracted from the drum unit than the exposure position;

an abutting pin provided integrally with at least one of one end side and the other end side of the optical print head in a longitudinal direction of the optical print head and protrude from the optical print head toward a drum unit side and an opposite side opposite to the drum unit side in a reciprocation direction, in which the optical print head moves reciprocally, and configured to abut an abutting portion formed on the drum unit so as to position the optical print head with respect to the drum unit;

a first fitted portion fixed to the main assembly at an opposite side opposite to a side where the drum unit is provided with respect to the optical print head, having a gap with a space formed in a perpendicular direction which is perpendicular to both the longitudinal direction and the reciprocation direction so that the abutting pin fits in, and configured to restrict movement of the abutting pin in the perpendicular direction; and a second fitted portion fixed to the main assembly, having a gap with a space formed in the perpendicular direction so that the optical print head fits in, and configured to restrict movement, in the perpendicular direction, of the optical print head moving from the retracted position to the exposure position; and wherein the optical print head moved by the movement mechanism from the retracted position to the exposure position is positioned with respect to the drum unit by abutment of the abutting pin with the abutting portion while the movement of the abutting pin in the perpendicular direction is restricted by the first fitted portion and while the movement of the optical print head in the perpendicular direction is restricted by the second fitted portion.

9. The image forming apparatus according to claim 8, wherein the abutting pin is provided on both one end side and the other end side of the optical print head in the longitudinal direction.

10. The image forming apparatus according to claim 8, wherein the first fitted portion and the second fitted portion are integral with each other.

11. The image forming apparatus according to claim 8, wherein the difference between the width in the perpendicular direction of the gap formed by the second fitted portion and the width in the perpendicular direction of the optical print head moving through the gap is larger than the difference between the width in the perpendicular direction of the gap formed by the first fitted portion and the width in the perpendicular direction of the abutting pin moving within the gap, and wherein the optical print head moved to the exposure position by the movement mechanism is situated closer toward the drum unit side than the gap formed by the second fitted portion, and the optical print head and second fitted portion are not in contact.

12. The image forming apparatus according to claim 8, wherein the difference between the width in the perpendicular direction of the gap formed by the second fitted portion and the width in the perpendicular direction of the optical print head moving through the gap is larger than the difference between the width in the perpendicular direction of the gap formed by the first fitted portion and the width in the perpendicular direction of the abutting pin moving within the gap, and wherein, in a state where the optical print head is situated at the exposure position, movement in the perpendicular direction of the abutting pin is restricted by the abutting portion and the first fitted portion, and movement in the perpendicular direction of the optical print head situated within the gap formed by the second fitted portion is not restricted by the second fitted portion.

13. The image forming apparatus according to claim 8, wherein the difference between the width in the perpendicular direction of the gap formed by the second fitted portion and the width in the perpendicular direction of the one end side of the optical print head that fits to the gap is 0.5 mm or more but 2 mm or less, and wherein the difference between the width in the perpendicular direction of the gap formed by the first fitted portion and the width in the perpendicular direction of the abutting pin fit to the gap is 10 μm or more but 30 μm or less.

14. An image forming apparatus comprising:

a drum unit including a photosensitive drum and being replaceable by being mounted into and dismounted from a main assembly;

an optical print head configured to expose the photosensitive drum;

a movement mechanism configured to reciprocally move the optical print head between an exposure position where the photosensitive drum is exposed, and a retracted position that is further retracted from the drum unit than the exposure position;

an abutting pin provided integrally with at least one of one end side and the other end side of the optical print head in a longitudinal direction of the optical print head and protrude from the optical print head toward a drum unit side and an opposite side opposite to the drum unit side in a reciprocation direction, in which the optical print head moves reciprocally, and configured to abut an abutting portion formed on the drum unit so as to position the optical print head with respect to the drum unit;

a first guiding portion fixed to the main assembly, and configured to guide movement of the abutting pin moving from the retracted position to the exposure position; and a second guiding portion fixed to the main assembly, and configured to guide movement of the optical print head moving from the retracted position to the exposure position, wherein the optical print head moved by the movement mechanism from the retracted position to the exposure position is positioned with respect to the drum unit by abutment of the abutting pin with the abutting portion while the movement of the abutting pin is guided by the first guiding portion and while the movement of the optical print head is guided by the second guiding portion.

15. The image forming apparatus according to claim 14, wherein the abutting pin is provided on both one end side and the other end side of the optical print head in the longitudinal direction.

16. The image forming apparatus according to claim 14, wherein the second guiding portion restricts the movement in a perpendicular direction, which is perpendicular to both a longitudinal direction of the optical print head and the reciprocation direction, of the optical print head moving from the retracted position to the exposure position.

17. The image forming apparatus according to claim 16, wherein, in the perpendicular direction, the second guiding portion contacts with the optical print head moving from the retracted position to the exposure position.

18. The image forming apparatus according to claim 16, wherein the second guiding portion is not in contact with the optical print head when the optical print head is located at the exposure position.

19. The image forming apparatus according to claim 16, wherein the first guiding portion restricts the movement of the abutting pin in the perpendicular direction.

20. The image forming apparatus according to claim 14, wherein the first guiding portion and the second guiding portion are integral with each other.

* * * * *